US011629496B2

(12) United States Patent
Smith et al.

(10) Patent No.: US 11,629,496 B2
(45) **Date of Patent: *Apr. 18, 2023**

(54) SHINGLES WITH INCREASED HYDROPHOBICITY

(71) Applicant: Owens Corning Intellectual Capital, LLC, Toledo, OH (US)

(72) Inventors: William Smith, Pataskala, OH (US); Scott Schweiger, Newark, OH (US); Jonathan Verhoff, Granville, OH (US); Ozma Lane, Columbus, OH (US); Kevin Click, Heath, OH (US); Daniel Buckwalter, Howard, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/743,764

(22) Filed: May 13, 2022

(65) Prior Publication Data

US 2022/0268025 A1 Aug. 25, 2022

Related U.S. Application Data

(63) Continuation of application No. 17/098,909, filed on Nov. 16, 2020, now Pat. No. 11,359,377, which is a (Continued)

(51) Int. Cl.
*E04D 1/00* (2006.01)
*E04D 1/20* (2006.01)

(52) U.S. Cl.
CPC ..... *E04D 1/20* (2013.01); *E04D 2001/005* (2013.01)

(58) Field of Classification Search
CPC .... E04D 1/20; E04D 1/00; E04D 1/26; E04D 1/28; E04D 13/17; E04D 2001/005; (Continued)

(56) References Cited

U.S. PATENT DOCUMENTS 1,494,380 A 5/1924 Schutte
2,263,200 A 11/1941 Wheeler et al.
(Continued)

FOREIGN PATENT DOCUMENTS

AU 2009245565 A1 11/2009
CA 2460741 A1 4/2003
(Continued)

OTHER PUBLICATIONS

Author Unknown, Pubchem Online, Calcium Stearate (Year: 2022).
(Continued)

*Primary Examiner* — Chi Q Nguyen
(74) *Attorney, Agent, or Firm* — Calfee, Halter & Griswold LLP

(57) ABSTRACT

A shingle including a substrate having a first surface defining an upper side of the shingle and an opposing second surface defining a lower side of the shingle; asphalt infiltrating the substrate to form a first asphalt coating on the first surface of the substrate and a second asphalt coating on the second surface of the substrate; a plurality of granules embedded in the first asphalt coating; a first hydrophobic material; and a second hydrophobic material that is a different composition than the first hydrophobic material and the second hydrophobic material comprises a metal stearate, wherein the lower side of the shingle includes a lower surface and the first and the second hydrophobic material are disposed on the lower surface.

19 Claims, 15 Drawing Sheets

Related U.S. Application Data continuation of application No. 16/393,548, filed on Apr. 24, 2019, now Pat. No. 10,865,565.

(60) Provisional application No. 62/696,563, filed on Jul. 11, 2018.

(58) Field of Classification Search
CPC ..... Y10T 428/24364; Y10T 428/24413; Y10T 428/2438; Y10T 428/24388; Y10T 428/24372
USPC .... 52/518, 525, 302.1, 309.1, 533; 428/142, 428/143, 144, 145, 147
See application file for complete search history.

(56) References Cited

U.S. PATENT DOCUMENTS 2,332,221 A 10/1943 Harshberger
2,438,890 A 4/1948 Baskin
2,833,673 A 5/1958 Hart et al.
3,042,193 A 7/1962 Wendt
3,045,395 A 7/1962 George et al.
3,138,897 A 6/1964 Mccorkle
3,239,992 A 3/1966 Hodgson
3,247,631 A 4/1966 Lovness
3,252,257 A 5/1966 Price et al.
3,813,280 A 5/1974 Olszyk et al.
3,903,340 A 9/1975 Shepherd
4,078,104 A 3/1978 Martin
4,173,489 A 11/1979 Crawford et al.
4,243,426 A 1/1981 Marzocchi et al.
4,447,500 A 5/1984 Ferris
4,992,315 A 2/1991 Zickell et al.
5,082,704 A 1/1992 Higgins
5,240,760 A 8/1993 George et al.
5,382,449 A 1/1995 Hedges
5,756,214 A 5/1998 Waldron et al.
5,996,300 A 12/1999 Hamlin
6,426,309 B1 7/2002 Miller et al.
6,506,444 B1 1/2003 Mahr et al.
6,524,682 B1 2/2003 Leavell
6,531,200 B2 3/2003 Zickell et al.
6,610,147 B2 8/2003 Aschenbeck
6,635,140 B2 10/2003 Phillips et al.
6,701,685 B2 3/2004 Rippey
6,709,994 B2 3/2004 Miller et al.
6,919,398 B1 7/2005 Born et al.
6,921,787 B2 7/2005 Bate
7,183,358 B2 2/2007 Bastelberger et al.
7,238,408 B2 7/2007 Aschenbeck et al.
7,375,152 B2 5/2008 Bate
7,442,270 B2 10/2008 Bartek
7,449,233 B2 11/2008 Arora
7,452,598 B2 11/2008 Shiao et al.
7,514,017 B2 4/2009 Bhamidipati
7,524,545 B2 4/2009 Bany et al.
7,541,059 B2 6/2009 Aschenbeck et al.
7,651,559 B2 1/2010 Whitaker et al.
7,737,057 B2 6/2010 Bany et al.
7,803,725 B2 9/2010 Payne et al.
7,805,909 B2 10/2010 Teng et al.
7,833,339 B2 11/2010 Whitaker et al.
7,977,259 B2 7/2011 Ratcliff et al.
8,058,342 B1 11/2011 Stevens et al.
8,530,034 B2 9/2013 Khan et al.
8,568,524 B2 10/2013 Li et al.
8,771,826 B2 7/2014 Whitaker et al.
9,259,860 B2 2/2016 Kalkanoglu et al.
9,446,568 B2 9/2016 Larson et al.
9,511,566 B2 12/2016 Grube et al.
9,574,350 B2 2/2017 Loftus et al.
9,670,677 B2 6/2017 Shiao et al.
9,700,915 B2 7/2017 Ruda
9,834,626 B2 12/2017 Chisholm et al.
9,850,623 B2 12/2017 Krigstin et al.
9,970,153 B2 5/2018 Deng et al.
10,060,132 B2 8/2018 Beerer et al.
10,113,314 B2 10/2018 Humphreys
10,458,119 B2 10/2019 Grubka et al.
10,584,494 B2 3/2020 Wise et al.
10,697,179 B2 6/2020 Humphreys
10,865,565 B2 12/2020 Smith et al.
10,865,566 B2 12/2020 Smith et al.
10,865,567 B2 * 12/2020 Smith ..... E04D 1/20
11,124,968 B2 9/2021 Vermilion et al.
11,136,761 B2 10/2021 Vermilion et al.
11,359,377 B2 * 6/2022 Smith ..... E04D 1/20
11,396,753 B1 * 7/2022 Hradisky ..... E04D 13/1478
2003/0068469 A1 4/2003 Aschenbeck et al.
2004/0014385 A1 1/2004 Greaves, Jr. et al.
2004/0206035 A1 10/2004 Kandalgaonkar
2004/0258883 A1 12/2004 Weaver
2005/0072110 A1 4/2005 Shiao et al.
2005/0252141 A1 11/2005 Kerkar et al.
2005/0260910 A1 11/2005 Brzozowski et al.
2006/0179767 A1 8/2006 Miller et al.
2006/0235143 A1 10/2006 Muller et al.
2006/0240224 A1 10/2006 Khan et al.
2006/0243388 A1 11/2006 Kubiak et al.
2007/0049144 A1 3/2007 Brzozowski et al.
2007/0224135 A1 9/2007 Liu et al.
2007/0261337 A1 11/2007 Whitaker et al.
2008/0011194 A1 1/2008 Mecca et al.
2008/0044626 A1 2/2008 Aschenbeck et al.
2008/0086970 A1 4/2008 Teng et al.
2008/0115444 A1 5/2008 Kalkanoglu et al.
2008/0193778 A1 8/2008 Bakir et al.
2009/0220743 A1 9/2009 Aschenbeck et al.
2009/0249728 A1 10/2009 Teng et al.
2010/0005745 A1 1/2010 Harrington, Jr.
2010/0098912 A1 4/2010 Snyder et al.
2010/0151198 A1 6/2010 Khan
2010/0203290 A1 8/2010 Whitaker et al.
2010/0236178 A1 9/2010 Loftus et al.
2010/0291818 A1 11/2010 Youn
2010/0307087 A1 12/2010 Zoellner
2011/0072752 A1 3/2011 Aschenbeck et al.
2011/0139366 A1 6/2011 Belt et al.
2011/0257295 A1 10/2011 Li et al.
2011/0265407 A1 11/2011 Bryson
2011/0283646 A1 11/2011 Vermilion et al.
2012/0258282 A1 10/2012 Hammond
2012/0260597 A1 10/2012 Jenkins et al.
2012/0288678 A1 11/2012 Grube et al.
2012/0305171 A1 12/2012 Hammond
2013/0089707 A1 4/2013 Faure
2013/0122232 A1 5/2013 Hopkins, II
2013/0167965 A1 7/2013 Cheney et al.
2013/0171414 A1 7/2013 Shiao et al.
2014/0272402 A1 9/2014 Dubey et al.
2015/0175317 A1 6/2015 Imai et al.
2015/0239005 A1 8/2015 Humphreys
2015/0240495 A1 8/2015 Vermilion et al.
2015/0275521 A1 10/2015 Bader et al.
2016/0186437 A1 6/2016 Harrington et al.
2016/0244969 A1 8/2016 Beerer et al.
2016/0369509 A1 12/2016 Leitch et al.
2017/0029649 A1 2/2017 Ali et al.
2017/0321423 A1 11/2017 Situ-Loewenstein et al.
2017/0362830 A1 12/2017 Buckingham et al.
2018/0051465 A1 2/2018 Grubka et al.
2018/0281017 A1 10/2018 Humphreys et al.
2018/0291629 A1 10/2018 Humphreys
2018/0363302 A1 12/2018 Beerer et al.
2019/0017273 A1 1/2019 Vermilion et al.
2019/0032337 A1 1/2019 Sipag et al.
2019/0077700 A1 3/2019 Xu et al.
2019/0271160 A1 9/2019 Freeborg et al.
2019/0277028 A1 9/2019 Chevillard et al.
2021/0164228 A1 6/2021 Fu et al.
2021/0214944 A1 7/2021 Verhoff et al.
2021/0381240 A1 12/2021 Vermilion et al.
2021/0381241 A1 12/2021 Vermilion et al.
2022/0056695 A1 * 2/2022 Mercado ..... E04D 1/34

(56) References Cited

U.S. PATENT DOCUMENTS

| | | | | |
|---|---|---|---|---|
| 2022/0186499 | A1* | 6/2022 | Srinivasa | B65D 19/0093 |
| 2022/0298793 | A1* | 9/2022 | Boss | E04D 1/20 |
| 2022/0307261 | A1* | 9/2022 | Aschenbeck | E04D 1/26 |

FOREIGN PATENT DOCUMENTS

| | | | |
|---|---|---|---|
| CA | 2508484 | C | 7/2010 |
| CA | 2759718 | A1 | 5/2013 |
| CA | 2559855 | C | 5/2015 |
| CA | 2882641 | A1 | 8/2015 |
| CA | 2921279 | A1 | 8/2016 |
| CA | 2933050 | A1 | 12/2016 |
| CA | 2923675 | C | 8/2017 |
| CA | 3035791 | A1 | 9/2019 |
| CA | 3044450 | A1 | 1/2020 |
| CA | 3100855 | A1 | 1/2020 |
| CN | 1439683 | A | 9/2003 |
| CN | 200958267 | Y | 10/2007 |
| CN | 203499128 | U | 3/2014 |
| CN | 203654622 | U | 6/2014 |
| CN | 105131765 | A | 12/2015 |
| CN | 105802410 | A | 7/2016 |
| CN | 107177246 | A | 9/2017 |
| DE | 102007050727 | A1 | 4/2008 |
| EP | 2455560 | A2 | 5/2012 |
| GB | 813520 | A | 5/1959 |
| GB | 1398895 | A | 6/1975 |
| WO | 03031748 | A2 | 4/2003 |
| WO | 03044124 | A1 | 5/2003 |
| WO | 03097757 | A1 | 11/2003 |
| WO | 2004050774 | A2 | 6/2004 |
| WO | 2006060714 | A1 | 6/2006 |
| WO | 2007078903 | A1 | 7/2007 |
| WO | 2007133393 | A1 | 11/2007 |
| WO | 2014038701 | A1 | 3/2014 |
| WO | 2016082025 | A1 | 6/2016 |
| WO | 2016210379 | A1 | 12/2016 |
| WO | 2019077604 | A1 | 4/2019 |
| WO | 2020006430 | A1 | 1/2020 |
| WO | 2020168019 | A1 | 8/2020 |

OTHER PUBLICATIONS

Splash Proof, LLC, "What is Splash Proof Nanotechnology Coating?" (2018), 2 pages, retrieved from the internet at: https://splashproofamerica.com/our-product/.

NanoSeal Tile Roof Sealant (2017-2018), 7 pages, retrieved from the internet at: http://nanoseal.com/tile-roof-coating/.

T.T Chau et al., "A review of factors that affect contact angle and implications for flotation practice," Advances in Colloid and Interface Science 150, pp. 106-115 (2009).

Office Action from U.S. Appl. No. 16/393,548 dated Mar. 18, 2020.

Notice of Allowance from U.S. Appl. No. 16/393,548 dated Aug. 13, 2020.

Office Action from U.S. Appl. No. 16/793,117 dated Mar. 19, 2020.

Notice of Allowance from U.S. Appl. No. 16/793,117 dated Aug. 13, 2020.

Office Action from U.S. Appl. No. 16/793,131 dated Mar. 19, 2020.

Notice of Allowance from U.S. Appl. No. 16/793,131 dated Aug. 14, 2020.

Office Action from U.S. Appl. No. 17/098,909 dated Oct. 21, 2021.

Notice of Allowance from U.S. Appl. No. 17/098,909 dated Feb. 15, 2022.

* cited by examiner

SHINGLES WITH INCREASED HYDROPHOBICITY

CROSS REFERENCE TO RELATED APPLICATIONS

This application is a continuation of U.S. patent application Ser. No. 17/098,909, filed on Nov. 16, 2020, now U.S. Pat. No. 11,359,377, which is a continuation of U.S. patent application Ser. No. 16/393,548, filed on Apr. 24, 2019, now U.S. Pat. No. 10,865,565, which claims priority to and benefit of U.S. Provisional Application No. 62/696,563, filed on Jul. 11, 2018, the entire disclosures of which are incorporated herein by reference.

FIELD

The present application relates to roofing materials, such as shingles. In particular, the present application relates to roofing materials, such as shingles, with increased hydrophobicity as compared to otherwise identical, roofing materials or shingles.

BACKGROUND

Asphalt-based roofing materials, such as roofing shingles, roll roofing, and commercial roofing, are installed on the roofs of buildings to provide protection from the elements, and in some instances to give the roof an aesthetically pleasing look. Typically, the roofing material is constructed of a substrate such as a glass fiber mat or an organic felt, an asphalt coating on the substrate, and a surface layer of granules embedded in the asphalt coating. Furthermore, physical and chemical factors such as surface roughness and heterogeneity as well as particle shape and size have been found to influence the contact angle and wetting behavior of solid particles. See, e.g., T. T Chau, et al., "A review of factors that affect contact angle and implications for flotation practice," Advances in Colloid and Interface Science 150, pp. 106-115 (2009). The entire disclosure of the Chau reference is incorporated herein by reference.

SUMMARY

In one exemplary embodiment, In one exemplary embodiment, a shingle is provided that includes a substrate having a first surface defining an upper side of the shingle and an opposing second surface defining a lower side of the shingle; asphalt infiltrating the substrate to form a first asphalt coating on the first surface of the substrate and a second asphalt coating on the second surface of the substrate; a plurality of granules embedded in the first asphalt coating; a first hydrophobic material; and a second hydrophobic material that is a different composition than the first hydrophobic material and the second hydrophobic material comprises a metal stearate, wherein the lower side of the shingle includes a lower surface and the first and the second hydrophobic material are disposed on the lower surface.

In certain embodiments, the shingle further includes a layer of backdust disposed between the second asphalt coating and the first hydrophobic material.

In certain embodiments, the second hydrophobic material is disposed on the first hydrophobic material.

In certain embodiments, the shingle is a laminated shingle.

In certain embodiments, the first hydrophobic material comprises silanes, waxes, silicones, siloxanes, styrene-butadiene rubber (SBR), esters of acrylic resins, or combinations thereof.

In certain embodiments, the first hydrophobic material includes a silicone selected from the group consisting of polyether-modified siloxane, polyether-modified polysiloxane, polyether-modified polydimethylsiloxane, dimethyl silicone fluid, emulsions of silicone rubber, silicone oil, and polydimethylsiloxane.

In certain embodiments, upon application, the first hydrophobic material comprises a solution or aqueous emulsion.

In certain embodiments, the metal stearate is zinc stearate, calcium stearate, magnesium stearate, or combinations thereof.

In certain embodiments, the shingle further includes an adhesive disposed on the lower surface and a further coating of the second hydrophobic material is disposed on the adhesive.

In another exemplary embodiment, a substrate having a first surface defining an upper side of the shingle and an opposed a second surface defining a lower side of the shingle; an asphalt composition infiltrating the substrate to form a first asphalt coating on the first surface of the substrate and a second asphalt coating on the second surface of the substrate; a plurality of granules embedded in the first asphalt coating; a hydrophobic material and a surfactant, wherein each of the hydrophobic material and the surfactant are disposed on the lower side of the shingle.

In certain embodiments, the surfactant comprises a salt of a fatty acid.

In certain embodiments, the salt of a fatty acid is selected from sodium laurate, potassium oleate, sodium oleate, sodium stearate, or combinations thereof.

In certain embodiments, the hydrophobic material and surfactant are disposed on the lower side of the shingle as a mixture.

In certain embodiments, the hydrophobic material is disposed the lower side of the shingle and the surfactant is disposed on at least a portion of the hydrophobic material.

In certain embodiments, the surfactant is disposed on at least a portion of the lower side of the shingle and the hydrophobic material is disposed on at least a portion of the surfactant.

In certain embodiments, the shingle further includes a layer of backdust on the second asphalt coating and the hydrophobic material is a coating on the layer of backdust.

In certain embodiments, the shingle is a laminated shingle.

In certain embodiments, upon application, the first hydrophobic material comprises a solution or aqueous emulsion.

In certain embodiments, the shingle further includes an adhesive and a coating of a second hydrophobic material is disposed on the adhesive.

DETAILED DESCRIPTION

In the exemplary embodiments herein, the invention of the present application is described for use with roofing shingles. However, it should be understood that the invention of the present application may be used with other types of roofing material, such as, for example, asphalt-based roll roofing, underlayments, and commercial roofing.

The general inventive concepts encompass, at least in part, the use of a hydrophobic material on one or more surfaces of a roofing shingle. The hydrophobic material may be added to the top surface, bottom surface, edges, and/or adhesive of the roofing shingle. Advantageously, it has been found that the use of a hydrophobic material on one or more of the surfaces of the shingle will help to reduce or eliminate the infiltration or wicking of water between the layers of stacked shingles during shipping and storage. In certain embodiment, the hydrophobic coating may provide additional benefits. Advantageously, it has also been found that the use of a hydrophobic coating on the surfaces of the shingle helps to prevent the shingles from sticking to each other when stacked. Further, granule adhesion may be improved through the use of a hydrophobic coating on the surface of the granules.

Figure 1A:
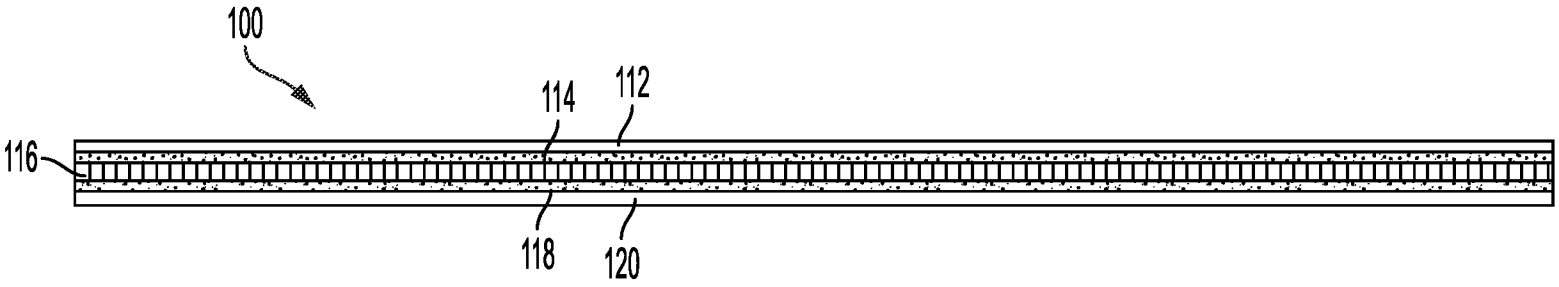
FIG. 1A is a side elevational view of an exemplary embodiment of a shingle.

As shown in FIG. 1A, a shingle 100 generally comprises a substrate 116 that is infiltrated with asphalt forming a first asphalt coating 114 on the top surface of the substrate 116 and a second asphalt coating 118 on the bottom surface of the substrate 116. The shingle also generally comprises a surface layer of granules 112 embedded in the first asphalt coating 114 and a backdust layer of particles 120 embedded in the second asphalt coating 118. The first asphalt coating 114 is positioned above the substrate 116 when the shingle 100 is installed on a roof and the second asphalt coating 118 is positioned below the substrate 116 when the shingles are installed on the roof.

Figure 2A:
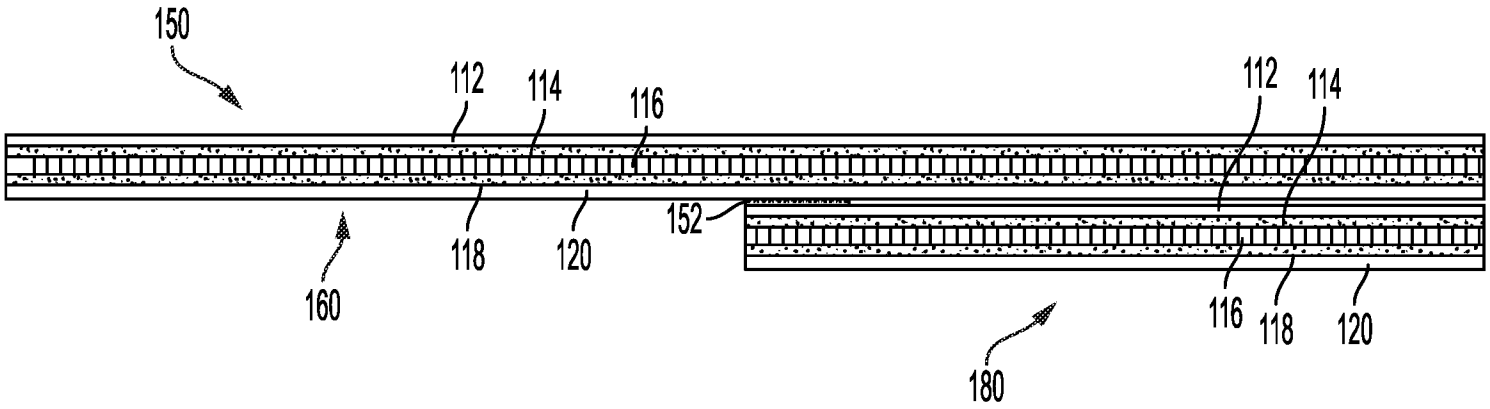
FIG. 2A is a side elevational view of a laminated shingle.

A shingle may also comprise one or more sheets laminated together to form a laminated shingle. For example, as shown in FIG. 2A, a shingle 150 comprises an upper or overlay sheet 160 attached to a lower or underlay sheet 180 with an adhesive 152 to form the laminated shingle 150. The overlay sheet 160 extends the full width of the laminated shingle 150 and includes cutouts (not shown) defining tabs (not shown) on a front portion of the laminated shingle 150. An optional release paper covered adhesive strip (not shown) may be disposed on a lower or rear surface of the overlay sheet 160 along a rear headlap portion of the laminated shingle 150. Similar to the shingle 100, each sheet generally comprises a substrate 116, a first asphalt coating 114 on the top surface of the substrate 116, a surface layer of granules 112 embedded in the first asphalt coating 114, a second asphalt coating 118 on the bottom surface of the substrate 116, and a backdust layer of particles 120 embedded in the second asphalt coating 118.

Figure 1B:
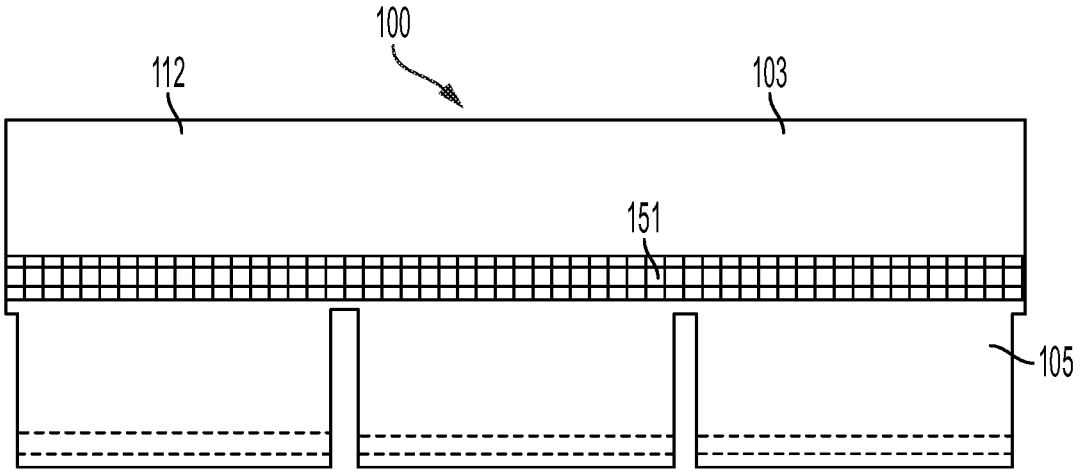
FIG. 1B is a top view of the shingle of FIG. 1A.

As seen in FIG. 1B, the shingle 100 of FIG. 1A includes a tab portion 105, which is defined by tabs and cutout sections, and a headlap portion 103. The upper surface of the headlap portion 103 includes a surface layer of granules 112 and, optionally, reinforcement layer 151. The laminated shingle 150 of FIG. 2B includes the overlay sheet 160 and the underlay sheet 180 adhered to the bottom of the overlay sheet 160. The overlay sheet 160 includes a tab portion 167, which is defined by tabs and cutout sections, and a headlap portion 161. Through the cutout sections of tab portion 167 the underlay sheet 180 is visible. The upper surface of the headlap portion 161 includes a surface layer of granules (not shown) and, optionally, reinforcement layer 151.

Figure 1C:
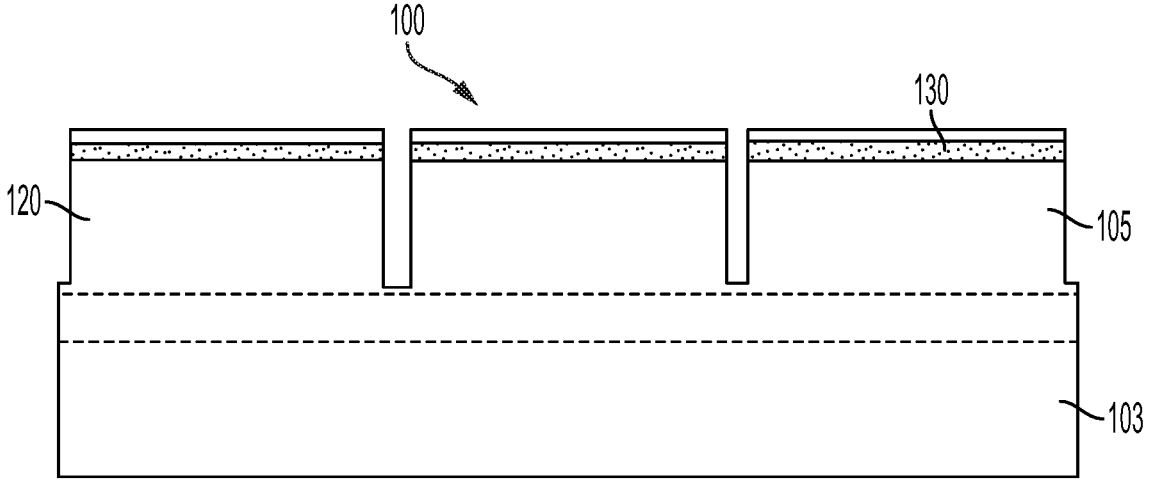
FIG. 1C is a bottom view of the shingle of FIG. 1A.

As shown in FIG. 1C, the shingle 100 includes an adhesive 130 applied to a lower surface of the tab portion 105 of the shingle 100. Adhesive 130 may be an adhesive, sealant, or the like (herein after the adhesive). Similar to the shingle 100, the laminated shingle 150 shown in FIG. 2D includes an adhesive 130 applied to a lower surface of the tab portion 167 of the shingle 150. While the adhesive 130 is shown as a strip, the adhesive 130 is not so limited and instead may be applied in various forms and configurations including, but not limited to, dots, lines, discontinuous segments, or combinations thereof. The adhesive 130 adheres the tab portions 105, 167 of an upper course of shingles on a roof to the headlap portions 103, 161 of a lower course of shingles on the roof. The resulting adhesive bond helps prevent wind uplift of the shingles on the roof.

Shingles according to the present disclosure may be formed as a single layer tabbed shingle, as described above with respect to FIGS. 1A, 1B, and 1C, or as a laminated shingle, as described above with respect to FIGS. 2A, 2B, 2C, and 2D.

The substrate(s) of the shingle can be any type known for use in reinforcing asphalt-based roofing materials, such as a web, scrim, or felt of fibrous materials such as mineral fibers, cellulose fibers, rag fibers, mixtures of mineral and synthetic fibers, or the like. Combinations of materials can also be used in the substrate. In certain embodiments, the substrate is a nonwoven web of glass fibers. The substrate may be any conventional substrate used in asphalt shingles, roll roofing, low-slope membranes, and the like.

The asphalt coatings are generally formed from a layer of hot, melted asphalt applied to the substrate. The asphalt coating can be applied to the substrate in any suitable manner. For example, the substrate can be submerged in the asphalt or the asphalt can be rolled on, sprayed on, or applied to the substrate by other means. The asphalt coatings may be applied in any conventional manner and in any conventional amount or thickness.

The asphalt coating, which may also be referred to as the asphalt coating composition, may include any type of bituminous material suitable for use on a roofing material, such as asphalts, tars, pitches, or mixtures thereof. Suitable asphalts for use in the asphalt coating composition include manufactured asphalts produced by refining petroleum or naturally occurring asphalts. The asphalt coating composition may include various types or grades of asphalt, including flux, paving grade asphalt blends, propane washed asphalt, oxidized asphalts, and/or blends thereof. The asphalt coating composition may include one or more additives including, but not limited to, polymers, waxes, inorganic fillers, mineral stabilizers, recycled asphalt streams, and oils.

As indicated above, the asphalt coating composition may include a polymer. Asphalt compositions that include polymers may be referred to as polymer-modified asphalt compositions. Suitable polymers include, but are not limited to styrene-butadiene-styrene (SBS), styrene-butadiene rubber (SBR), styrene-isoprene-styrene (SIS), thermoplastic polyolefin (TPO), atactic polypropylene, and combinations thereof. In certain embodiments, the asphalt coating composition may include from about 1 wt % to about 25 wt %, in other embodiments from about 2 wt % to about 15 wt %, and in other embodiments from about 3 wt % to about 10 wt % polymer based upon the total weight of the asphalt coating composition.

In certain embodiments, the asphalt (with the inclusion of any optional additives) may be characterized by a penetration value, which is often referred to colloquially as a pen or pen value. The penetration value may be determined using the procedure detailed in ASTM D, which is incorporated herein by reference, at a temperature of 25° C. with a 100 gram weight. In certain embodiments, the penetration value may be greater than 15 penetration units, in other embodiments greater than 18 penetration units, and in other embodiments greater than 20 penetration units. In these or other embodiments, the penetration value may be less than 50 penetration units, in other embodiments less than 45 penetration units, and in other embodiments less than 40 penetration units. In certain embodiments, the penetration value may be from about 15 penetration units to about 50 penetration units, in other embodiments from about 18 penetration units to about 45 penetration units, and in other embodiments from about 20 penetration units to about 40 penetration units.

The adhesive 130 may be any type of adhesive that is able to bond two shingles together. In certain embodiment, the adhesive is an asphalt-based adhesive. Asphalt-based adhesives s include asphalt as the primary adhesion promoting constituent of the adhesive composition. In addition to asphalt, an asphalt-based adhesive composition may include polymers, waxes, fillers, oils, and combinations thereof.

In certain embodiments, the adhesive may be a heat-sensitive adhesive. A heat-sensitive adhesive, which may also be referred to as a thermally activated adhesive, is characterized by an activation temperature that when reached or exceeded allows the heat-sensitive adhesive to bond a shingle to an adjacent shingle. In certain embodiments, the activation temperature may be from about 70° F. to about 135° F., in other embodiments from about 80° F. to about 115° F., and in other embodiments from about 90° F. to about 100° F.

The granules are generally deposited onto the asphalt coating after the coating is applied to the substrate. The shingles may be engaged by one or more rollers to further embed the granules into the asphalt coating. The granules may comprise a variety of different materials. The granules may be ceramic roofing grade granules that are made in any known or conventional manner. Any type of roofing granule may be used. The granules may comprise a variety of different particle sizes and colors. Further, a variety of different granules may be blended together, e.g., to provide different color blends or to provide the appearance of varying thickness to the shingle.

The backdust particles are generally deposited onto the asphalt coating after the coating is applied to the substrate. The shingles may be engaged by one or more rollers to further embed the backdust particles into the asphalt coating. The backdust may comprise a variety of different materials, including but not limited to, Quartz ($SiO_2$), K-Feldspar ($KAlSi_3O_8$), Na-Feldspar ($NaAlSi_3O_8$), Dolomite ($CaMg(CO_3)_2$), pulverized sand, talc, mica, calcium carbonate, ground recycled glass, or other common inorganic material. The backdust may comprise a variety of different particle sizes. For example, the backdust particles may have an average particle size between about 20 μm and 1000 μm, 60 μm and 600 μm, 100 μm and 400 μm, or 100 μm and 300 μm. In certain embodiments, the backdust particles have an average particle size of about 200 μm. The backdust may be any material that prevents the shingles from sticking together after being stacked, packaged, and/or stored for a prolonged period of time.

Figure 2B:
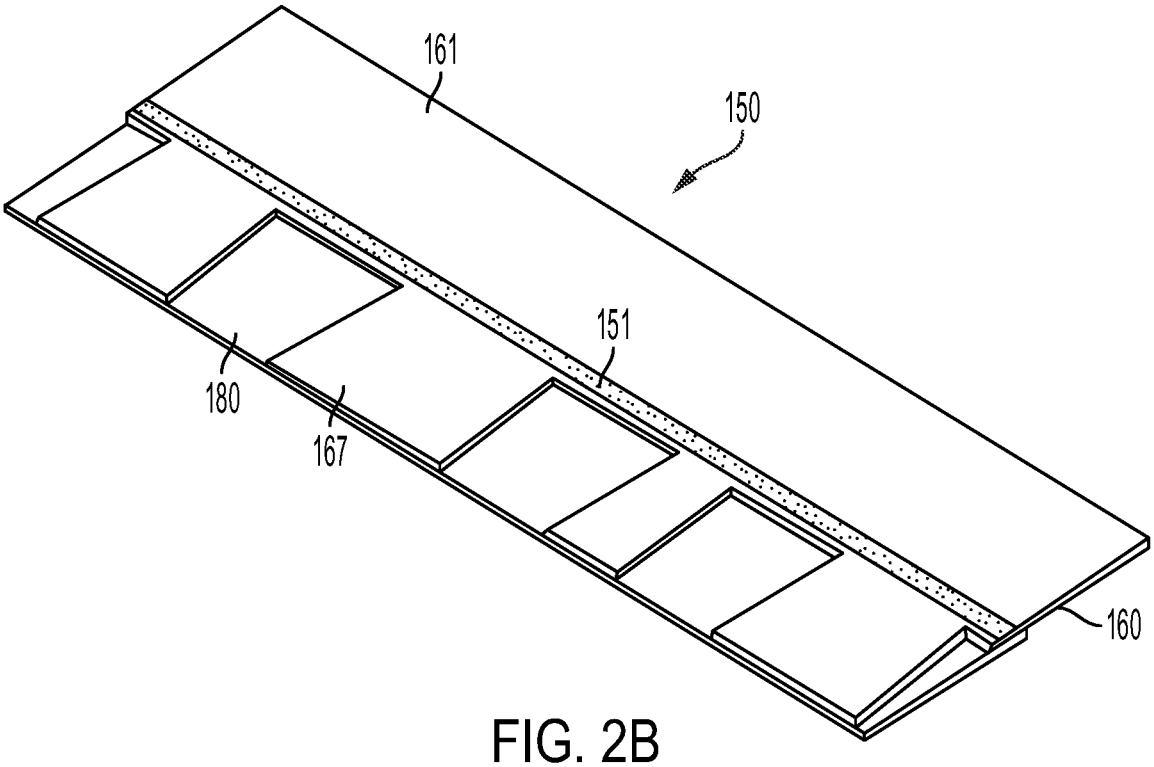
FIG. 2B is a top perspective view of the laminated shingle.

One or more portions of the shingle may comprise an additional layer, such as a reinforcement layer 151 (See FIGS. 1B and 2B). In certain embodiments, the additional layer may be attached to the asphalt coating, e.g., by the adhesive mixture of the asphalt coating or other adhesives. In certain embodiments, the additional layer may be a polymeric layer formed from, for example, a polyester, polyolefin (e.g., polypropylene or polyethylene), or the like. However, the additional layer may be formed from other materials, such as, for example, paper, film, scrim material, and woven or non-woven glass.

For example, in certain embodiments, the optional reinforcement layer of the shingle can be a strip of woven polyester material applied to the surface of the shingle after application of the asphalt coating, such that the asphalt material penetrates the strip between the woven fibers of the polyester fabric, to embed the strip of material in the base asphaltic layer and secure the strip to the shingle. The polyester strip may be applied prior to granule coating of the shingle, and the granules may not adhere to the strip-covered portion of the shingle. The strip of polyester material may, for example, define a shingle nail zone and provide reinforcement for the nailed portion of the shingle.

In certain embodiments, a portion of the lower surface of the shingle may be covered by a sheet of spun-bound nonwoven polyester web or mat material that is pressed into the hot asphalt material of the asphalt coating prior to backdust coating of the shingle. The hot asphalt material penetrates between the nonwoven polyester fibers to embed the mat in the base asphaltic layer. The nonwoven mat may provide additional impact resistance for the shingle, to resist damage caused by hail or other such impacts.

Figure 3A:
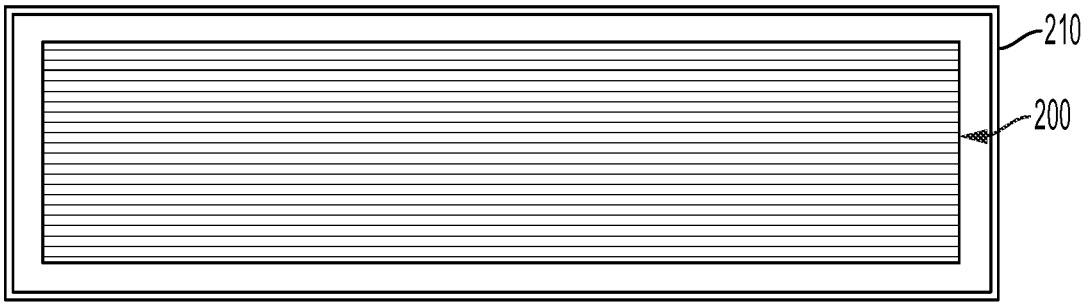
FIG. 3A illustrates an exemplary embodiment of shingles stacked in a package.
Figure 3B:
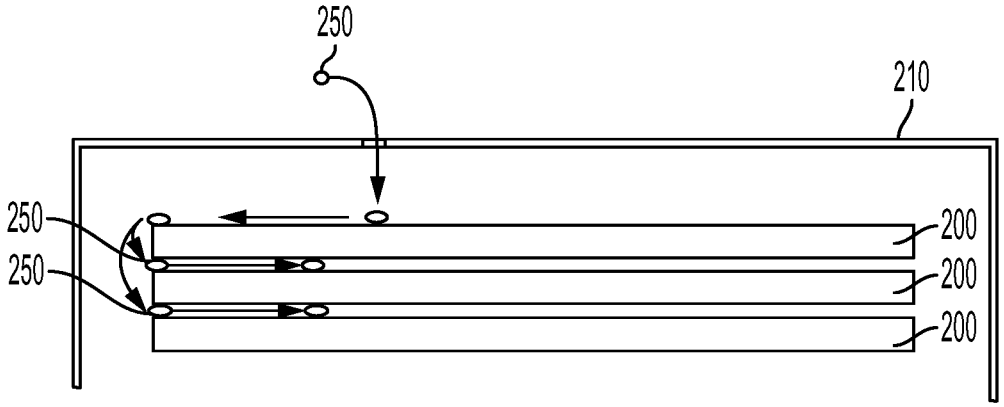
FIG. 3B illustrates an exemplary embodiment of shingles stacked in a package and moisture wicking or infiltrating between the layers of the stacked shingles.

Shingles are generally stacked and packaged for storage and transport, e.g. in a wrapper, bag, box, or the like. Typically, the shingles are stacked in either a front-to-back (i.e. granule side to bottom) or an alternating front-to-front/back-to-back configuration. When stacked, the adhesive strips of each shingles may be all aligned on a single side of the stack or the shingles may be rotated so the adhesive strip alternates sides in stack. In certain embodiments, release tape may be included between consecutively stacked shingles to prevent sticking. In other embodiments, there is no release tape between the shingles. In certain embodiments, the shingles may be packaged into a bundle. A bundle of shingles typically includes 16 to 22 shingles. The package may take a wide variety of forms, such as a plastic wrapper, a paper wrapper, a plastic bag, shrink wrap, a cardboard box, a polyethylene wrapper (e.g., 1.5-2.5 mil thick), or the like. FIG. 3A illustrates shingles 200 stacked in a package 210. Often, over time, the package 210 will develop small holes or openings that permit moisture penetration during extended storage periods. Further, the package 210 may become damaged during handling permitting moisture to enter the shingle package. As illustrated in FIG. 3B, the moisture 250 will often wick or infiltrate between the layers of stacked shingles 200 resulting in the shingles being in a wet condition.

As indicated above, the shingles include a hydrophobic material. While the term "hydrophobic material" is used throughout the specification, for ease of description when referring to shingles that include two or more hydrophobic materials of different formulations and/or locations on the shingle, the terms "first hydrophobic material" and "second hydrophobic material" are also used herein. In certain embodiments, the first and second hydrophobic material may be the same composition. In other embodiments, the first and second hydrophobic material may be the different compositions. Typically, when the hydrophobic material is applied to the upper surface, lower surface, and/or edges of the shingle, the hydrophobic material may be referred to as a first hydrophobic material, and when the hydrophobic material is applied to the adhesive, the hydrophobic material may be referred to as a second hydrophobic material. However, in certain embodiments, the second hydrophobic material may also be applied to upper surface, lower surface, and/or edges of the shingle when a first hydrophobic material of a different composition is already employed on the shingle.

The first hydrophobic material applied to the shingles may take a variety of different forms. For example, the first hydrophobic material may be a coating on one or more surfaces of the shingle. When employed as a coating on the shingle, the first hydrophobic material may be the outermost coating on one or more surfaces of the shingle. Further, the backdust and/or granules may be coated with a hydrophobic material before being applied to the shingle (e.g., at the supplier) and/or after being applied to the shingle. Further, the material of the backdust and/or granules themselves may have hydrophobic properties. The first hydrophobic material may also be applied to any surface of the shingle, such as, for example, around only the edges of the shingle, only on the back of the shingle, or on the back and front of the shingle. Further, the first hydrophobic material may also be applied only to the edges of the shingle bundle to prohibit moisture infiltration between the shingles.

The second hydrophobic material applied to the adhesive 130 may take a variety of different forms. For example, the hydrophobic material may be a coating on the surface of the adhesive 130. Further, the adhesive 130 can be coated with a hydrophobic material before being applied to the shingle and/or after being applied to the shingle. Further, the material of the adhesive itself can have hydrophobic properties.

Figure 6:
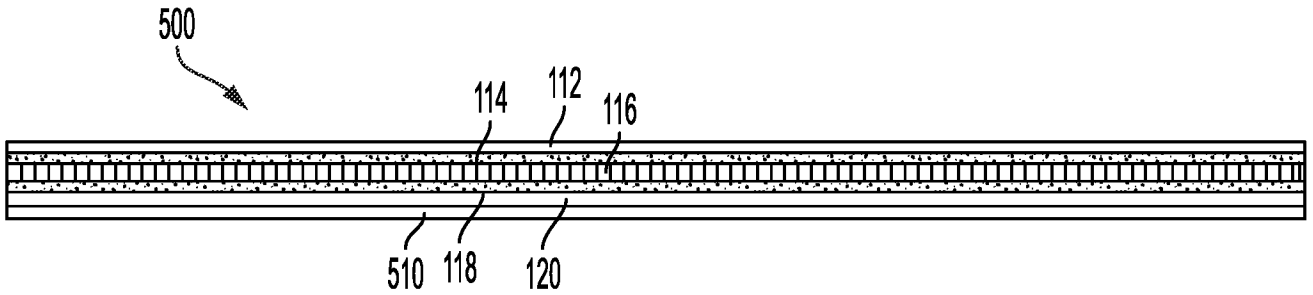
FIG. 6 is a cross sectional view of an exemplary embodiment of a shingle with a hydrophobic material applied to a back or lower surface of the shingle.
Figure 7A:
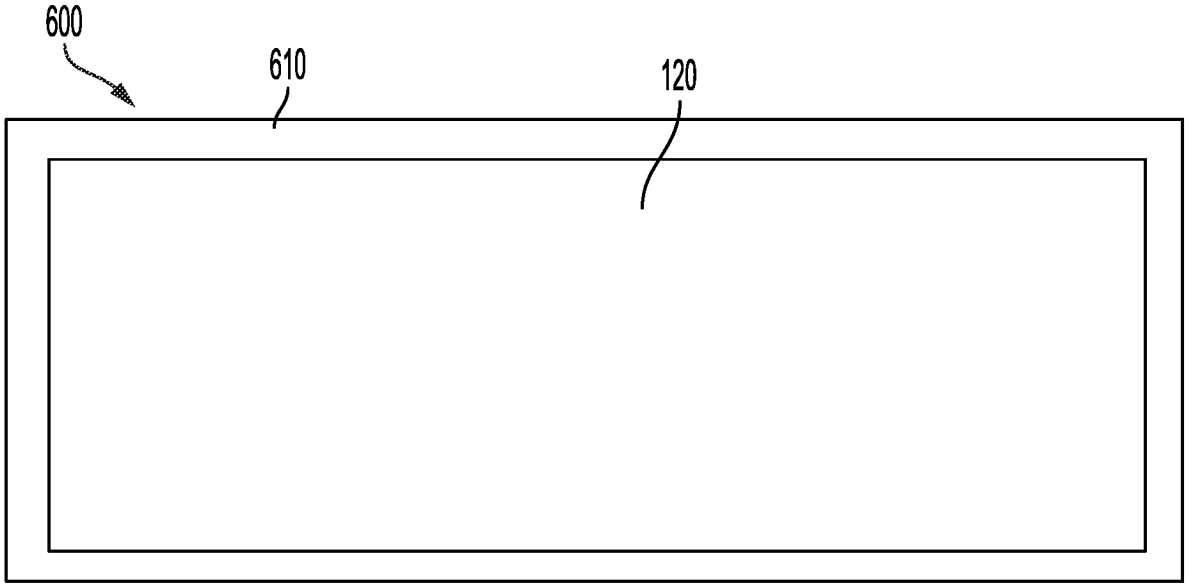
FIG. 7A is a bottom view of an exemplary embodiment of a shingle with a hydrophobic material applied only to edges of a lower surface of the shingle.

For example, FIG. 6 illustrates a cross sectional view of a shingle 500 with a first hydrophobic material 510 applied to the back or lower surface of the shingle. The first hydrophobic material 510 may be sprayed on, rolled on, or otherwise applied to the surface of the shingle 500. Further, the backdust of the shingle may be coated with the first hydrophobic material 510 before being applied to the shingle (e.g., at the supplier) and/or after being applied to the shingle or some of the backdust may be a hydrophobic material, such as titanium dioxide. FIG. 7A illustrates a bottom view of a shingle 600 with a hydrophobic material 610 applied only to the edges of the lower surface of the shingle. As shown, the first hydrophobic material 610 extends a distance between 0.5 inches and 3 inches in from each edge of the lower surface, such as between 1 and 2 inches from each edge of the lower surface. However, the first hydrophobic material may be applied closer or further from the edge of the lower surface, such as, for example, depending on the size and makeup of the shingle and/or the surrounding environmental conditions. It should be understood that the first hydrophobic material may be applied to other portions of the shingle as well, including the top surface and sides of the shingle.

Figure 7B:
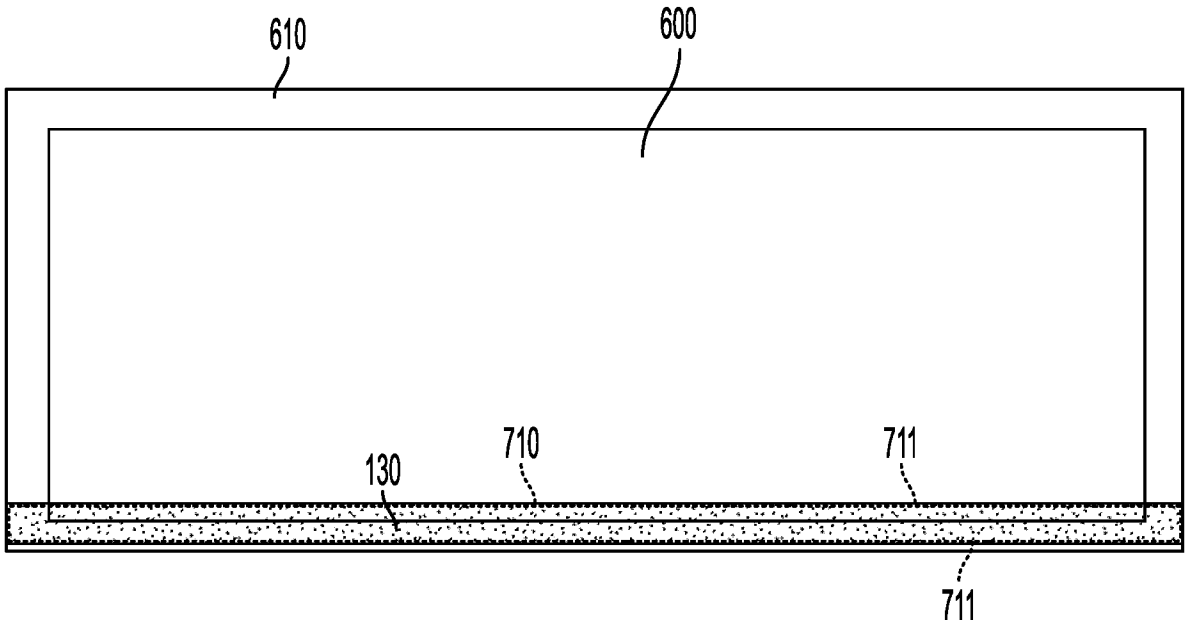
FIG. 7B is a bottom view of an exemplary embodiment of a shingle having a first hydrophobic material applied to a bottom surface of the shingle and a second hydrophobic material applied to an adhesive on the bottom surface of the shingle.

FIG. 7B illustrates an embodiment that is similar to the embodiment illustrated by FIG. 7A where a second hydrophobic material 710 is applied to the adhesive 130. The first hydrophobic materials 610 and/or 710 can be sprayed on, rolled on, or otherwise applied to the surface of the shingle 600 and/or the surface of the adhesive 130. FIG. 7B illustrates a bottom view of the shingle 600 with the first hydrophobic material 610 applied only to the edges of the lower surface of the shingle and the second hydrophobic material is applied only to the adhesive 130. As shown, the first hydrophobic material 610 can extend a distance between 0.5 inches and 3 inches in from each edge of the lower surface, such as between 1 inch and 2 inches from each edge of the lower surface. However, the first hydrophobic material may be applied closer or further from the edge of the lower surface, such as, for example, depending on the size and makeup of the shingle and/or the surrounding environmental conditions. The second hydrophobic material 710 can be applied substantially only to the adhesive 130 as illustrated or the second hydrophobic material 710 can be applied such that the hydrophobic material extends beyond edges 711 of the adhesive. It should be understood that the first and/or second hydrophobic materials 610, 710 can be applied to other portions of the shingle as well, including the top surface and sides of the shingle.

Referring back to FIG. 1D, in one exemplary embodiment, the first hydrophobic material 510 (illustrated by dashed lines) is applied to a rear surface 149 of the shingle 100. In the illustrated embodiment, the first hydrophobic material 510 is applied to the entire rear surface 149 or substantially the entire rear surface 149 of the shingle 100. In another exemplary embodiment (See FIG. 7A), the first hydrophobic material 510 is applied only to the edges of the lower surface of the laminated shingle 150.

Figure 1D:
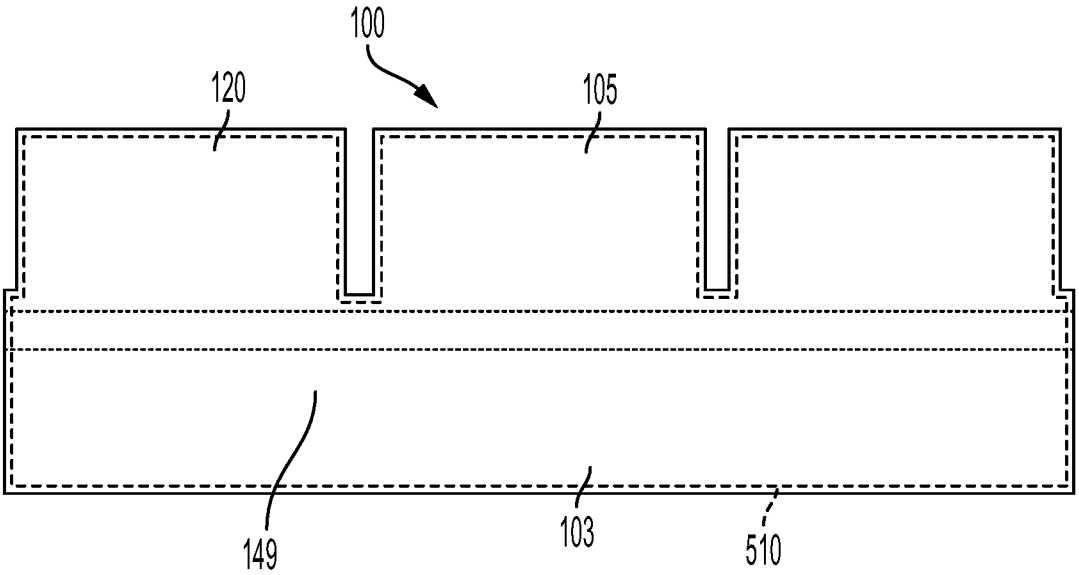
FIG. 1D is a bottom view of the shingle of FIG. 1A having a hydrophobic material applied to a bottom surface of the shingle.
Figure 1E:
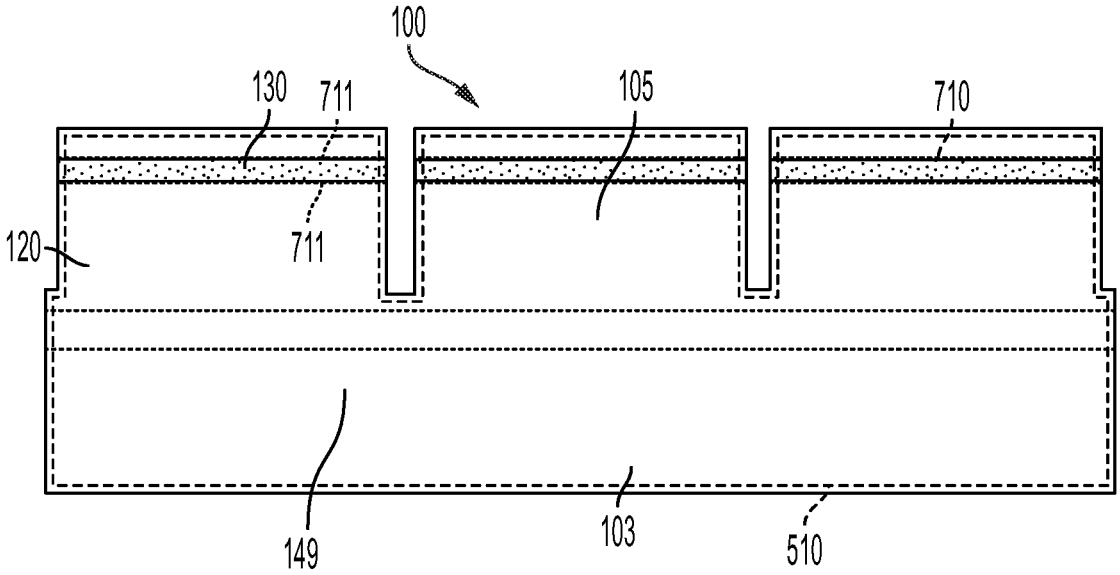
FIG. 1E is a bottom view of the shingle of FIG. 1A having a first hydrophobic material applied to a bottom surface of the shingle and a second hydrophobic material applied to an adhesive on the bottom surface of the shingle.

FIG. 1E illustrates an embodiment that is similar to the embodiment illustrated by FIG. 1D where a second hydrophobic material 710 is applied to the adhesive 130. The second hydrophobic material 710 can be sprayed on, rolled on, or otherwise applied to the surface of the adhesive 130. The second hydrophobic material 710 can be applied substantially only to the adhesive 130 as illustrated or the hydrophobic material 710 can be applied such that the hydrophobic material extends beyond edges 711 of the adhesive. It should be understood that the second hydrophobic material 710 can be applied to other portions of the shingle as well, including the top surface and sides of the shingle.

Referring back to FIGS. 2C, 2E, and 2F, in one exemplary embodiment, the first hydrophobic material 510 (illustrated by dashed lines) is applied to a rear surface 550 of the underlay sheet 180 and to a rear surface 552 of the overlay sheet 160. In the illustrated embodiment, the first hydrophobic material 510 is applied to the entire rear surface 550 or substantially the entire rear surface 550 of the underlay sheet 180. In the illustrated embodiment, the hydrophobic material 510 is applied to the portion 554 of the rear surface 552 of the overlay sheet 180 that is not covered by the underlay sheet 160 or that is substantially not covered by the underlay sheet. In one exemplary embodiment, the first hydrophobic material 510 is applied to a rear surface 552 of a headlap portion 556 of the overlay sheet 160 and the first hydrophobic material 510 is not applied to a rear surface 552 of tab portions 558 of the overlay sheet 160.

Figure 2C:
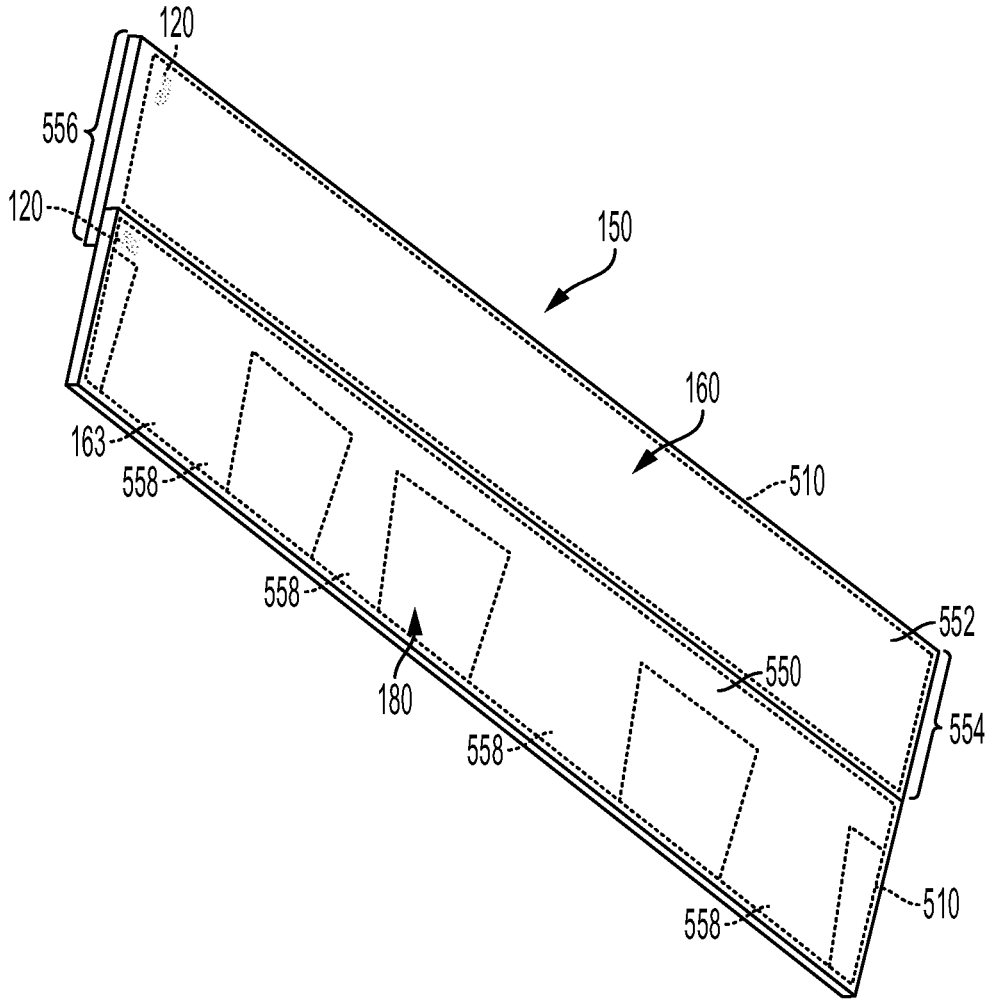
FIG. 2C is a bottom perspective view of the laminated shingle of FIG. 2B with a hydrophobic material applied to a bottom surface of the shingle.
Figure 2D:
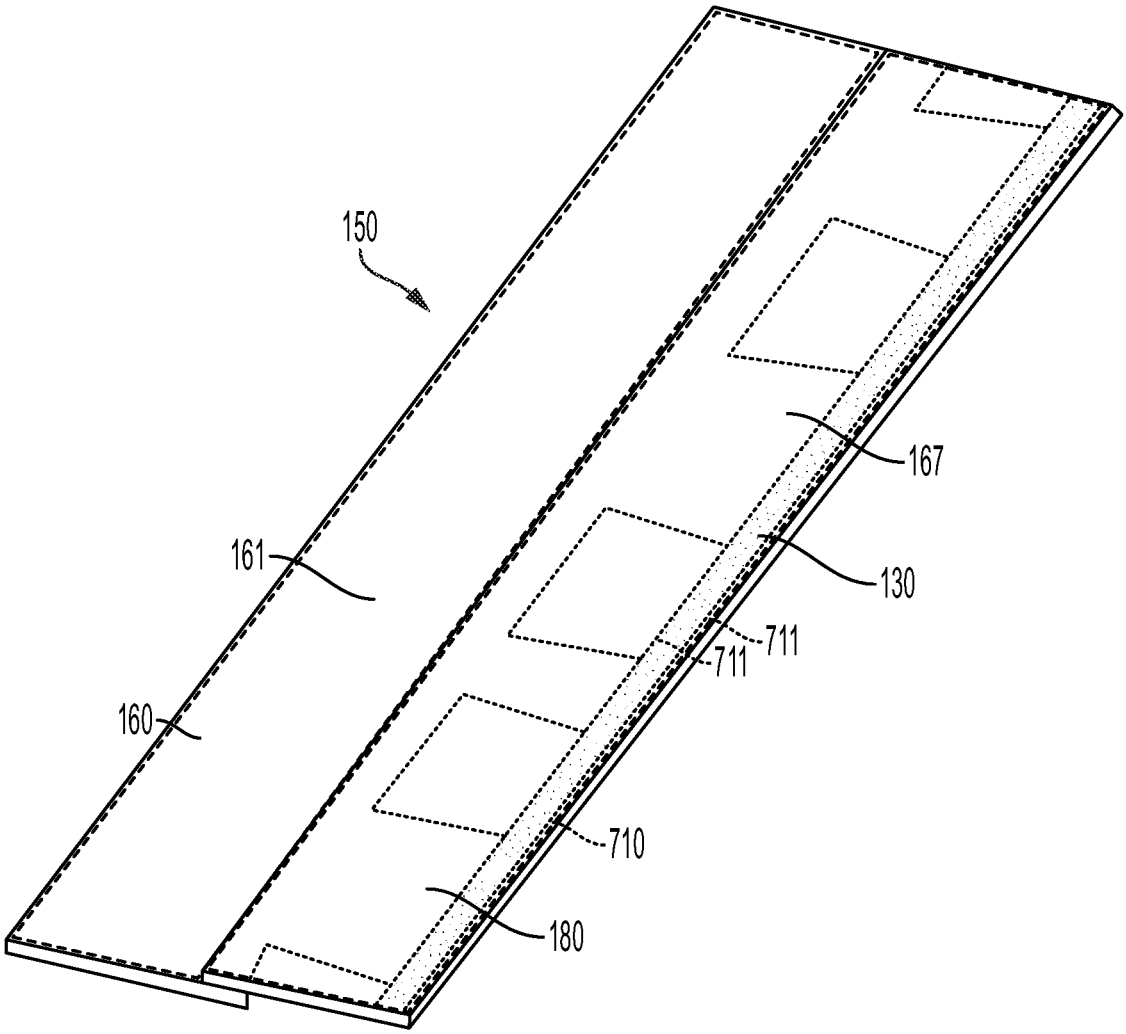
FIG. 2D is a bottom perspective view of the laminated shingle illustrated by FIG. 2A having a first hydrophobic material applied to a bottom surface of the shingle and a second hydrophobic material applied to an adhesive on the bottom surface of the shingle.
Figure 2E:
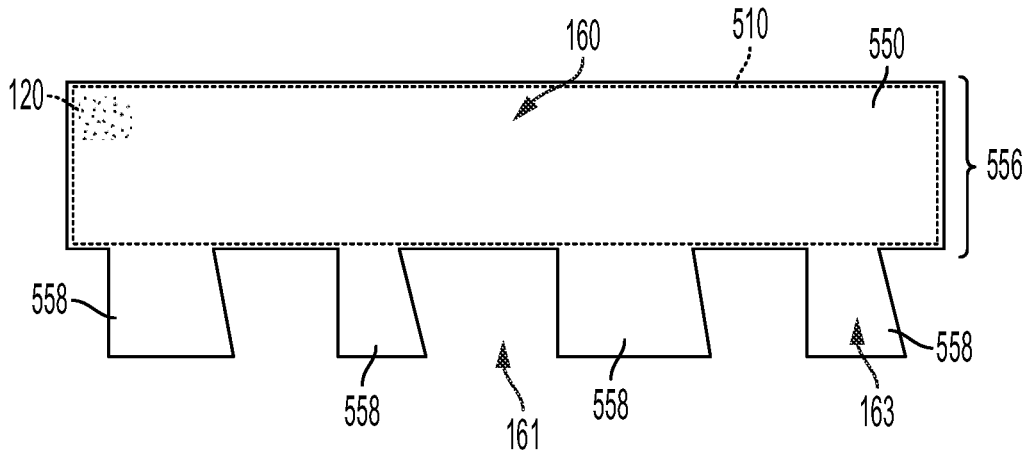
FIG. 2E is a bottom plan view of a top layer of the laminated shingle of FIG. 2B.
Figure 2F:
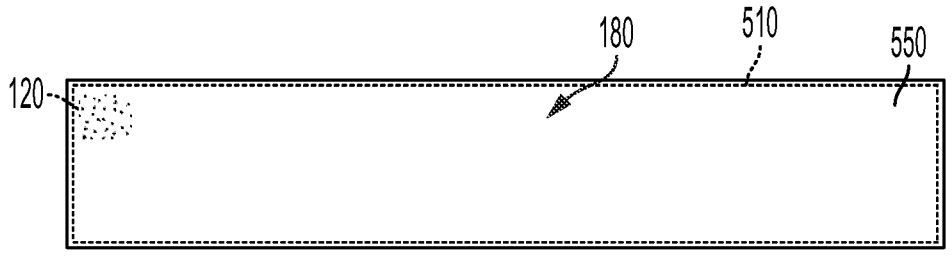
FIG. 2F is a bottom plan view of a bottom layer of the laminated shingle illustrated by FIG. 2B.

Referring to FIGS. 2C, 2E, and 2F, in one exemplary embodiment, the first hydrophobic material 510 is applied to a rear surface 550 of the underlay sheet 180 and to a rear surface 552 of the overlay sheet 160 before the underlay sheet 180 and the overlay sheet 160 are laminated together. In another exemplary embodiment, the first hydrophobic material 510 is applied to a rear surface 550 of the underlay sheet 180 and to a rear surface 552 of the overlay sheet 160 after the underlay sheet 180 and the overlay sheet 160 are laminated together.

In another exemplary embodiment, the first hydrophobic material 510 applied only to the edges of the lower surface of the laminated shingle 150. For example, the first hydrophobic material 510 extends a distance between 0.5 inches and 3 inches in from each edge of the lower surface, such as between 1 inch and 2 inches from each edge of the lower surface.

FIG. 2D illustrates an embodiment that is similar to the embodiment illustrated by FIGS. 2C, 2E, and 2F where a second hydrophobic material 710 is applied to the adhesive 130. The second hydrophobic material 710 can be sprayed on, rolled on, or otherwise applied to the surface of the adhesive 130. The second hydrophobic material 710 can be applied substantially only to the adhesive 130, as illustrated, or the second hydrophobic material 710 can be applied to extend beyond the edges 711 of the adhesive. It should be understood that the second hydrophobic material 710 can be applied to other portions of the shingle as well, including the top surface and the sides of the shingle.

Figure 5:
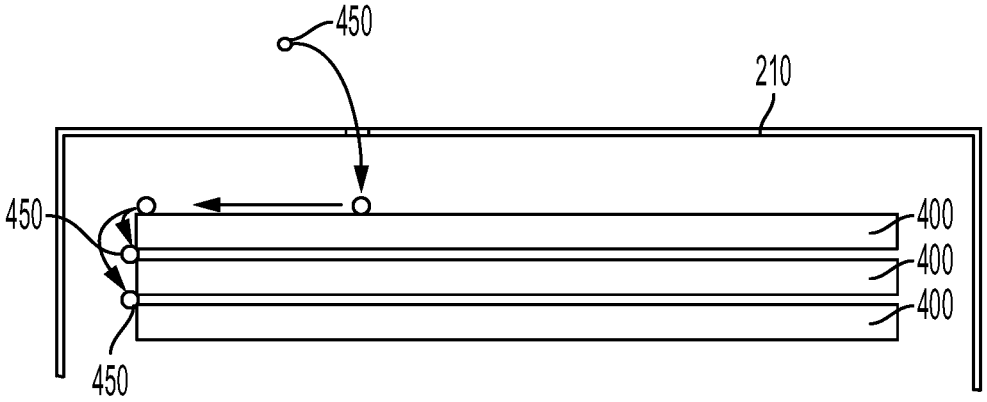
FIG. 5 illustrates of an exemplary embodiment where a moisture droplet is moving down along a side of a stack of shingles.

The Applicants have found that applying a first hydrophobic material to at least one of the upper surface (i.e., top) and the lower surface (i.e., back or bottom) of the shingle (e.g., around the edges of the lower surface) and/or a second hydrophobic material 710 to the adhesive 130 prevents or otherwise reduces moisture from infiltrating between the stacked shingles. As illustrated in FIG. 5, when moisture travels down the side of the stacked shingles, the moisture will attempt to infiltrate between the shingles. When the moisture contacts the first hydrophobic material applied to either the upper or lower surface of the shingle, or both, and/or the second hydrophobic material 710 applied to the adhesive 130 the moisture will be repelled by the hydrophobic material and "bead" up, which reduces the likelihood of the moisture infiltrating between the shingles, for example, through capillary action. As such, the hydrophobic material repels the moisture. As discussed below, Applicants have found that applying the first hydrophobic material to the lower surface and/or the second hydrophobic material 710 to the adhesive 130 sufficiently prohibits the moisture from infiltrating between the shingles. However, applying the hydrophobic material to both the upper and lower surfaces of the shingle further improves the hydrophobicity of the stacked shingles and further inhibits wicking of water between stacked shingles.

Applicants have established that applying a hydrophobic material to surfaces of the shingles and/or the adhesive 130 of the shingle increases the contact angle of a droplet on the surfaces and decreases the wetting of the shingle bundle by prohibiting the moisture from wicking or infiltrating between the stacked shingles. The contact angle of a moisture droplet is the angle formed by the moisture droplet at the three-phase boundary where the liquid, gas, and solid intersect. The greater contact angles are preferred to reduce the amount of moisture that infiltrates between the layers of shingles.

Figure 4A:
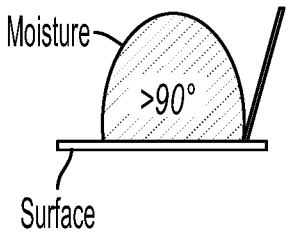
FIG. 4A illustrates the contact angle of a moisture droplet that is greater than 90 degrees.
Figure 4B:
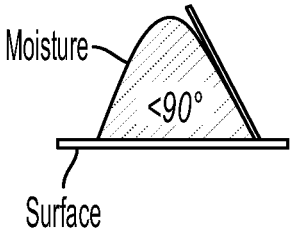
FIG. 4B illustrates the contact angle of a moisture droplet that is less than 90 degrees.

FIGS. 4A and 4B illustrate the contact angle of a moisture droplet of greater than 90 degrees and less than 90 degrees, respectively. FIG. 4B illustrates the moisture droplet having a contact angle less than 70 degrees with the hydrophobic material, e.g., between 40 degrees and 70 degrees, infiltrating between stacked shingles 400 (such as the shingles 100, 150) in the bundle. FIG. 5 illustrates a moisture droplet 450 having a contact angle greater than about 70 degrees with the hydrophobic material, e.g., between about 70 degrees and 120 degrees, that is inhibited from infiltrating between the shingles 400.

In certain embodiments, the parts of the shingle that includes the hydrophobic material (either the first hydrophobic material or the second hydrophobic material) may be characterized by the contact angle formed by a droplet of water on the surface of the hydrophobic material. The contact angle of a droplet of water may be measured at room temperature (i.e. 23° C.) using a goniometer on a 6 microliter droplet of deionized (DI) water. The measurement should be determined after the droplet has come to rest on the hydrophobic surface (e.g. between 10 to 20 seconds after the droplet is applied to the surface). Multiple determinations of the contact angle should be averaged (e.g. 5 or 10 replicates) to obtain a final value. In certain embodiments, a droplet of water on the hydrophobic material may form a contact angle greater than 70 degrees, in other embodiments greater than 80 degrees, and in other embodiments greater than 90 degrees. In these or other embodiments, the droplet of water on the hydrophobic material may form a contact angle in the range of 70 degrees to 135 degrees, in other embodiments a contact angle of 80 degrees to 120 degrees, and in other embodiments a contact angle of 90 degrees to 110 degrees. In these or other embodiments, the hydrophobic material is sufficient to inhibit water from infiltrating between the shingles such that the shingles are almost completely dry. In these or other embodiments, the amount of water on a shingle may be determined by visually inspecting a shingle and determined by exposing a bundle of shingles to 2.2 inches of rain per hour for 24 hours the area of water and then visually inspecting and calculating the percentage of the total surface area of the bottom of the second shingle from the top of the stack that is visibly wet. In these or other embodiments, the surface area of the bottom of the second shingle from the top of the stack has a total area that is wet of less than 25%, in other embodiments less than 15%, in other embodiments less than less than 10%, and in other embodiments less than less than 5%.

As indicated above, the hydrophobic material may improve granule adhesion when applied to the granules, for example, as a coating on the granules. Granule adhesion may be determined by following the testing methods in ASTM D4977, which is incorporated herein by reference. ASTM D4977 is a dry "as is" scrub test method for the determination of granule adhesion for granule-surfaced roofing under conditions of abrasion. The test method applies to "as manufactured" material without weathering exposure. Testing for granule adhesion may be performed by abrading the granule-coated surface of a specimen of roofing material for 50 cycles with a wire brush. The mass of the specimen of roofing material prior to abrasion is compared to the mass of the specimen of roofing material after abrasion to determine the loss in mass, which may also be referred to as scrub loss.

In certain embodiments, where the hydrophobic material is applied to the granules of a shingle, the shingle has a scrub loss of less than 1 g, in other embodiments, less than 0.8 g, in other embodiments less than 0.6 g, and in other embodiments less than 0.3 g. In these or other embodiments, the shingle has a scrub loss in the range of 0.05 g to 1 g, in other embodiments from 0.1 g to 0.8 g, in other embodiments from 0.15 g to 0.6 g, and in other embodiments from 0.2 g to 0.3 g.

In certain embodiments, where the hydrophobic material is applied to the granules of a shingle, the scrub loss may be compared to the scrub loss of comparable shingle that is identical with the exception that it does not include the hydrophobic material. In certain embodiments, where the hydrophobic material is applied to the granules of a shingle, the shingle has a scrub loss that is less than 90%, in other embodiments less than 80%, in other embodiments less than 70%, in other embodiments less than 60%, in other embodiments less than 50%, and in other embodiments less than 40% of the scrub loss of a comparable shingle.

As indicated above, the hydrophobic material may prevent shingles from sticking to each other when stacked. A lap shear test may be performed to determine the force required to separate the two shingles. A sample for the lap shear test may be prepared by placing a first 6 inch wide specimen of shingle on a second 6 inch wide specimen of shingle so that they have an overlap of 2 inches. A weight of 5 lbs is applied to the top of the two shingle samples for 24 hrs at 135° F. The two shingle specimen are then separated on a tensile tester, such as a Instron tensile tester, with crosshead speed of 2 inches per minute with a gauge length of 7 inches to calculate the breaking force required to separate the two specimen.

In certain embodiments, the shingles with hydrophobic material may be characterized by the force required to separate the shingles in a lap shear test. In certain embodiments, where the hydrophobic material is applied to the granules of a shingle and the shingle sample is prepared by placing two specimens face-to-face (i.e. granule side to granule side), the lap shear strength is less than 50 lbs of force, in other embodiments less than 25 lbs of force, in other embodiments less than 10 lbs of force, in other embodiments less than 8 lbs of force, in other embodiments less than 6 lbs of force, in other embodiments less than 4 lbs of force, and in other embodiments less than 3 lbs of force. In these or other embodiments, the lap shear strength in the range of from 0.1 lb of force to 50 lbs of force, in other embodiments from 0.2 lb of force to 25 lbs of force, in other embodiments from 0.4 lb of force to 10 lbs of force, in other embodiments from 0.5 lb of force to 8 lbs of force, in other embodiments from 0.6 lb of force to 6 lbs of force, in other embodiments from 0.8 lb of force to 4 lbs of force, and in other embodiments from 1 lb of force to 3 lbs of force.

In certain embodiments, where the hydrophobic material is applied to the granules of a shingle and the shingle sample is prepared by placing two specimens face-to-face, the lap shear strength may be compared to the lap shear strength of a comparable shingle that is identical with the exception that it does not include the hydrophobic material. In certain embodiments, where the hydrophobic material is applied to the granules of a shingle, the shingle has a lap shear strength that is less than 90%, in other embodiments less than 80%, in other embodiments less than 70%, in other embodiments less than 60%, in other embodiments less than 50%, and in other embodiments less than 40% of the lap shear strength of a comparable shingle.

In certain embodiments, where the hydrophobic material is applied to the lower side of the shingle (e.g. over the backdust layer) and the shingle sample is prepared by placing two specimens back-to-back the lap shear strength may be less than 50 lbs of force, in other embodiments less than 35 lbs of force, in other embodiments less than 25 lbs of force, in other embodiments less than 20 lbs of force, in other embodiments less than 15 lbs of force, in other embodiments less than 10 lbs of force, and in other embodiments less than 8 lbs of force. In these or other embodiments, the lap shear strength may be in the range of 0.1 lb of force to 50 lbs of force, in other embodiments from 0.2 lb of force to 35 lbs of force, in other embodiments from 0.5 lb of force to 25 lbs of force, in other embodiments from 1 lb of force to 20 lbs of force, in other embodiments from 1.5 lbs of force to 15 lbs of force, in other embodiments from 2 lbs of force to 10 lbs of force, and in other embodiments from 2.5 lbs of force to 8 lbs of force.

In certain embodiments, where the hydrophobic material is applied to the lower side of a shingle and the shingle sample is prepared by placing two specimens back-to-back, the lap shear strength may be compared to the lap shear strength of a comparable shingle that is identical with the exception that it does not include the hydrophobic material. In certain embodiments, where the hydrophobic material is applied to the granules of a shingle, the shingle has a the lap shear strength that is less than 80%, in other embodiments less than 60%, in other embodiments less than 50%, in other embodiments less than 40%, in other embodiments less than 30%, in other embodiments less than 20%, and in other embodiments less than 15% of the lap shear strength of a comparable shingle.

Shingles that employ an asphalt coating are prone to sticking together when stacked. This is sometimes referred to as bundle sticking. The problem of bundle sticking may be exacerbated when excessive weight is applied to the stack of asphalt shingles. The separation of shingles that are stuck together may cause delay in installation and damage to the shingles. Accordingly, it is often recommended that stacks of asphalt shingles on pallets of are not double stacked. Or, in other words, a pallet with a stack of asphalt shingles is not placed on top of another pallet with a stack of asphalt shingles. In particular, polymer-modified asphalt singles are particularly prone to sticking. As indicated above, polymer-modified asphalt includes at a polymer in the asphalt coating composition.

Figure 10:
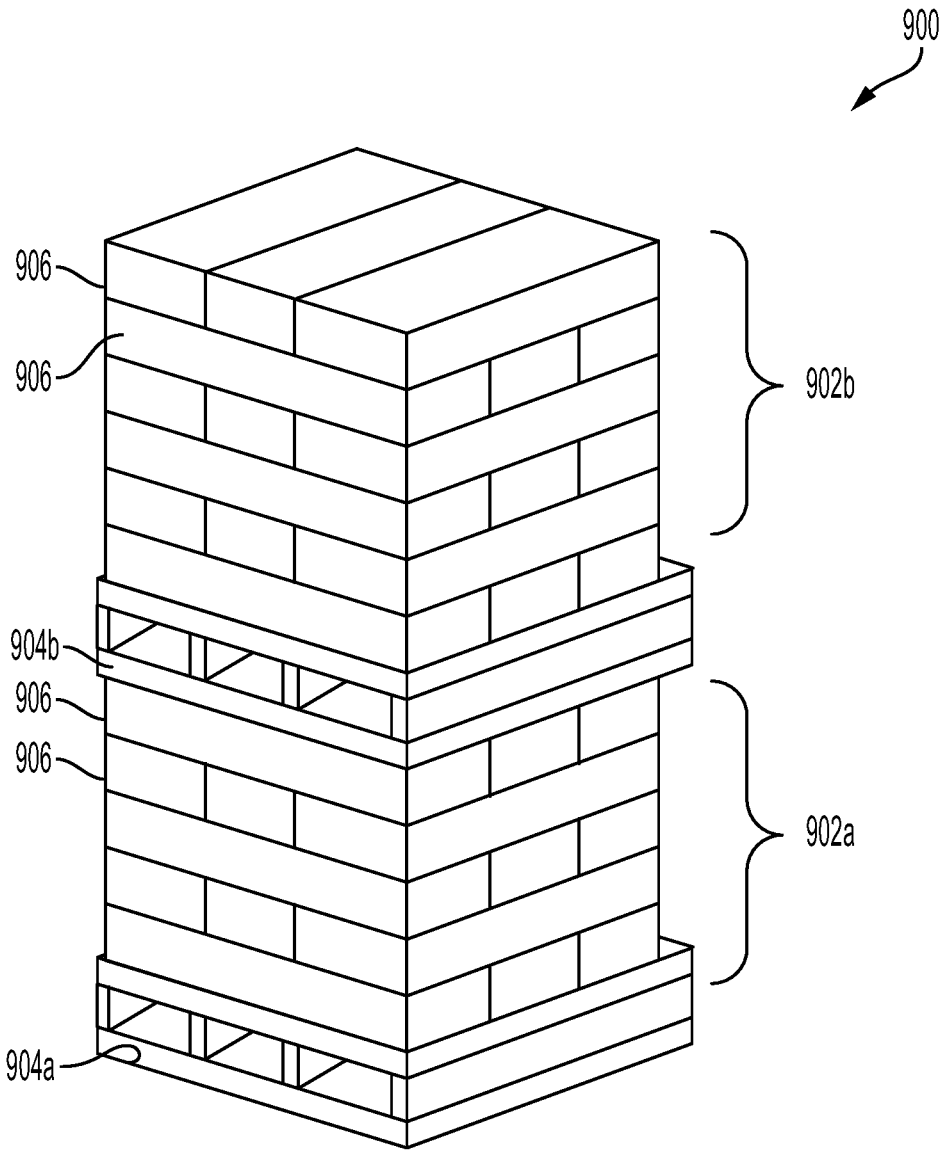
FIG. 10 is a schematic illustration of an exemplary embodiment that includes a first pallet of shingles and a second pallet of shingles, where the second pallet of shingles is stacked on top of the first pallet of shingles.

Advantageously, shingles that employ the hydrophobic material in accordance with the present invention have reduced sticking and may be "double stacked." With reference to FIG. 10, a double stack of shingles 900 is illustrated. The double stack of shingles 900 includes a first stack of shingles 902*a* stacked on top of a first pallet 904*a*. A second pallet 904*b* is stacked on the first stack of shingles 902*a*, and a second stack of shingles 902*b* is stacked on the second pallet 904*b*. Each of the first stack of shingles 902*a* and the second stack of shingles 902*b* is made of bundles of shingles 906. Each bundle of shingles 906 includes a packaged stack of shingles (not shown) that is stacked in either a front-to-back or an alternating front-to-front/back-to-back configuration. In certain embodiments, release tape may be included between consecutively stacked shingles. In other embodiments, due to the ability of the hydrophobic material to reduce sticking, the release tape may be omitted. In these or other embodiments, the shingles are stacked without the use of release tape. The packages of shingles may be packaged in a wrapper, bag, box, or the like. The package may take a wide variety of forms, such as a plastic wrapper, a paper wrapper, a plastic bag, shrink wrap, a cardboard box, a polyethylene wrapper (e.g., 1.5-2.5 mil thick), or the like. While the first stack of shingles 902*a* and the second stack of shingles 902*b* are shown as bundles of shingles 906 the stacks of shingles may take other configurations, layouts, and packaging based upon the, size, shape, transportation, and storage needs of the shingles.

In certain embodiments, the hydrophobic material of the present invention comprises certain particles or materials included in the backdust or granules of the shingle that increase the hydrophobicity of the shingle. Applicants have discovered that the addition of certain particles or materials in the backdust or granules of the shingles, even in small amounts, affects the hydrophobic/hydrophilic nature of the shingle.

Figure 9:
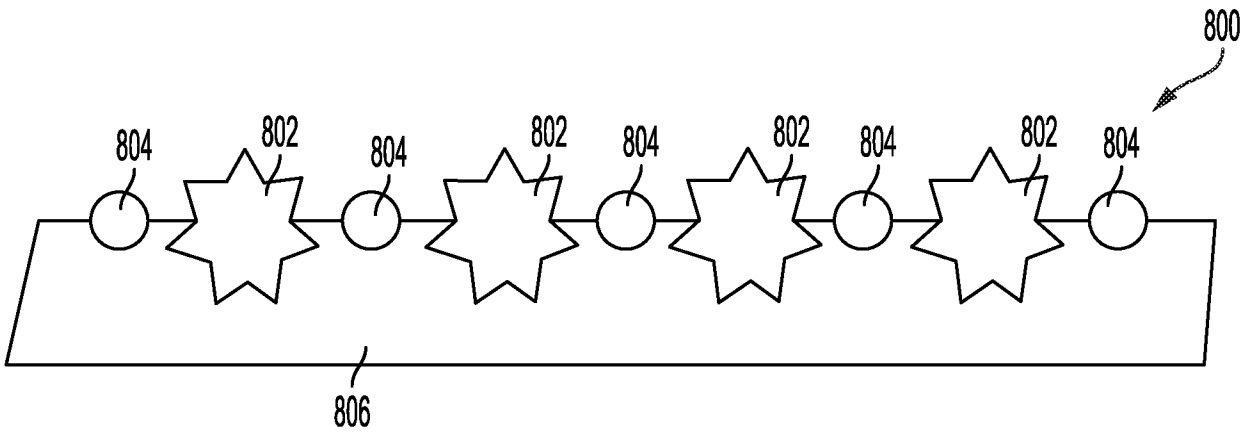
FIG. 9 illustrates an exemplary embodiment of a shingle having hydrophobic particles embedded in the asphalt coating along with other particles embedded in the asphalt coating.

For example, FIG. 9 illustrates a shingle 800 having hydrophobic particles 804 embedded in the asphalt coating 806 on the lower surface of the shingle along with backdust particles 802. In certain embodiments, the hydrophobic particles 804 are embedded in the asphalt coating on the upper surface of the shingle along with the granules. Similar to the hydrophobic coatings described above, the hydrophobic particles 804 increase the contact angle of the moisture contacting the back surface of the shingle, thus prohibiting moisture from infiltrating between the stacked shingles. The hydrophobic particles may be a variety of particles, including but not limited to Titanium dioxide ($TiO_2$), talc, and alumina.

The Applicants have discovered that certain titanium minerals make the shingles more hydrophobic as measured both by contact angle and water pickup through the back of the shingle, and also as measured with the bundle rain test. For example, in certain embodiments, small amounts of $TiO_2$ are added to the silica sand backdust on the lower surface of shingle sheets. In one embodiment, 0.25% $TiO_2$ was added to the silica sand before the backdust was applied to the back of the shingle. The addition of this $TiO_2$ increased the contact angle of the lower surface by more than 20 degrees (e.g. by approximately 22 degrees). Further, the 0.25% $TiO_2$ shingle was soaked by placing it on a wet sponge for about two weeks to measure the water absorption of the shingle. The weight of the shingle increased less than 1.5% during this time, whereas the weight of a comparable shingle without the 0.25% $TiO_2$ increased almost 2.0%, over a 30% increase. As such, the $TiO_2$ reduced the shingle's ability to absorb moisture.

The 0.25% $TiO_2$ shingle was also tested to determine whether the $TiO_2$ could withstand rain and whether the $TiO_2$ affected the adhesion of the backdust or granules. Applicants found that no noticeable amount of the $TiO_2$ washed off the lower surface of the shingle and that there was no observable difference in shingle bond strength when compared to the shingle without the $TiO_2$.

Suitable hydrophobic materials for use as the first hydrophobic material include compositions that increase the hydrophobicity of the surface of the roofing shingle as measured by the contact angle of moisture droplets. Exemplary hydrophobic materials include, but are not limited to silanes, waxes, silicones, siloxanes, styrene-butadiene rubber (SBR), esters of acrylic resins, and combinations thereof. In addition to the hydrophobic material, optional components may be included in the composition for applying the first hydrophobic material. Optional components may include, acids, bases, surfactants, and combinations thereof.

In certain embodiments, the silane compound may be defined by the formula $$SiR_4$$

where each R is individually selected from a hydrogen atom and a monovalent organic group. In certain embodiments, each R is individually a monovalent organic group. In certain embodiments, the monovalent organic group may a linear, cyclic, or branched hydrocarbon group having from 1 to 20 carbon atoms. In certain embodiments, the monovalent organic group may have 2 to 6 carbon atoms. Optionally, one or more of the hydrogen or carbon atoms in the hydrocarbon groups may be substituted with a heteroatom such as a silicon atom or a halogen atom. Exemplary monovalent organic groups include methyl, ethyl, and phenyl groups.

In certain embodiments, the siloxane compound may be defined by the formula $$SiR_{4-n}(OR')_n$$

where each R is individually selected from a hydrogen atom and a monovalent organic group, each R' is a monovalent organic groups, and n is an integer from 1 to 4. In certain embodiments, each R is individually a monovalent organic group. In certain embodiments, the monovalent organic group may a linear, cyclic, or branched hydrocarbon group having from 1 to 20 carbon atoms. In certain embodiments, the monovalent organic group may have 2 to 6 carbon atoms. Optionally, one or more of the hydrogen or carbon atoms in the hydrocarbon groups may be substituted with a heteroatom such as a silicon atom or a halogen atom. Exemplary monovalent organic groups include methyl, ethyl, and phenyl groups.

Suitable silicones include polysiloxane oligomers and polymers. The silicone may be linear, branched, or cyclic, or crosslinked in structure. In certain embodiments, the silicone may be defined by the formula $$[R_2SiO]_n$$

where each R is individually a monovalent organic group and n is in the range of 5 to 10,000. In certain embodiments, n may be from 10 to 5,000, in other embodiments n may be from 20 to 500. In certain embodiments, the monovalent organic group may a linear, cyclic, or branched hydrocarbon group having from 1 to 20 carbon atoms. In certain embodiments, the monovalent organic group may have 2 to 6 carbon atoms. Optionally, one or more of the hydrogen or carbon atoms in the hydrocarbon groups may be substituted with a heteroatom, such as a silicon atom or a halogen atom, or a polysiloxane chain. Exemplary monovalent organic groups include methyl, ethyl and phenyl groups. Exemplary silicones include polyether-modified siloxane, polyether-modified polysiloxane, polyether-modified polydimethylsiloxane, dimethyl silicone fluid, emulsions of silicone rubber, silicone oil, polydimethylsiloxane.

Exemplary waxes include paraffin and/or microcrystalline waxes.

The first hydrophobic material may be applied neat (as is), in a mixture, in a solvent or in an emulsion. In certain embodiments, where the first hydrophobic material is applied in an emulsion or using a carrier such as a solvent, the hydrophobic material may be applied to the shingle and then any solvent is then removed through evaporation. For example, the first hydrophobic material may be applied as an aqueous emulsion to the front and/or back of the shingle.

The first hydrophobic materials can be applied in a wide variety of different concentrations. For example, the range of concentrations in an aqueous based system can be 0.1 wt % to 10 wt %, such as 0.5 wt % to 5 wt %, such as 1 wt % to 3 wt %.

In certain embodiments, the first hydrophobic material may be applied on a dry basis to the shingle in an amount of greater than 0.0002 g/in$^2$, in other embodiments greater than 0.0003 g/in$^2$, and in other embodiments greater than 0.0004 g/in$^2$. In these or other embodiments, the first hydrophobic material may be applied on a dry basis to the shingle in an amount of less than 0.0015 g/in$^2$, in other embodiments less than 0.001 g/in$^2$, in other embodiments, and in other embodiments less than 0.0008 g/in$^2$. In certain embodiments, the first hydrophobic material may be applied on a dry basis in an amount in the range of 0.0002 g/in$^2$ to from 0.0015 g/in$^2$, in other embodiments from 0.0003 g/in$^2$ to 0.001 g/in$^2$, in other embodiments, and in other embodiments from 0.0003 g/in$^2$ to 0.0008 g/in$^2$.

Suitable hydrophobic materials for use as the second hydrophobic material include compositions that increase the hydrophobicity of the surface of the roofing shingle and/or the adhesive as measured by the contact angle of moisture droplets. The second hydrophobic material can take a variety of different forms. Any combination or subcombination of the materials disclosed herein can be used.

In certain embodiments, the hydrophobic material used as the second hydrophobic material may be selected from one of the first hydrophobic materials as described above. Exemplary hydrophobic materials for use as the second hydrophobic material include, but are not limited to silanes, waxes, silicones, siloxanes, styrene-butadiene rubber (SBR), esters of acrylic resins, water based wax emulsions, silicone emulsions, silicone rubber emulsions, and solid lubricants. In addition to the hydrophobic material, optional components may be included in the composition for applying the second hydrophobic material. Optional components may include acids, bases, and surfactants, and combinations thereof.

Solid lubricants that can be used include, but are not limited to, metal stearates, such as zinc stearate, calcium stearate, and magnesium stearate. The amount of solid lubricant can be selected to be great enough to act as a lubricant during manufacturing, stacking, and packaging of the shingles, and low enough to not affect the bonding performance of the adhesive 130. The stearate portion of the material 710 can be attracted/absorbed into an asphalt adhesive over a period of time, such as greater than 1 hour, such as greater than 12 hours, such as greater than 1 day, such as greater than 3 days, such as greater than 1 week, etc. After the stearate is absorbed into the adhesive 130, the edge of the shingle having the adhesive 130 will have the same hydrophobicity as the other three edges of the shingle. When the first hydrophobic material is applied to the entire front and/or rear surface of the shingle or the first hydrophobic material is applied to all four edges of the shingle, all four edges of the shingle will be hydrophobic after the stearate is absorbed into the adhesive.

The surfactant may be applied in combination with the hydrophobic material or separately (e.g. either before or after the addition of the hydrophobia material). Suitable surfactants that may be included in the hydrophobic material include non-ionic silicones, salts of fatty acids, alkylbenzene sulfonates, alkyl sulfates, alkyl ether sulfates, ethoxylates, amphoteric surfactants, and combinations thereof. Specific examples of salts of fatty acids include sodium laurate, potassium oleate, sodium oleate, sodium stearate, and combinations thereof. In these or other embodiments, the composition may include from 0.1 wt % to 3 wt %, in other embodiments from 0.2 wt % to 2 wt %, and in other embodiments from 1.5 wt % to 0.5 wt % of the surfactant based on the total weight of the hydrophobic material composition.

The second hydrophobic materials can be applied in a wide variety of different concentrations. For example, the range of concentrations in an aqueous based system can be 0.1 wt % to 10 wt %, such as 0.5 wt % to 5 wt %, such as 1 wt % to 3 wt %. In one exemplary embodiment, the second hydrophobic material 710 (which can be any of the materials disclosed herein) is applied to the edge of the shingle with the adhesive in an area approximately 2 inches at the edge of the shingle and along the length. In one example, an about 2 wt % polydimethylsiloxane in water mixture is applied to the edge of the shingle with the adhesive in an area approximately 2 inches at the edge of the shingle and along the length.

A variety of different amounts of the second hydrophobic material 710 can be applied to the shingle. In one exemplary embodiment, 0.1 lbs to 2.0 lbs of solution, such as 0.2 lbs to 1.0 lbs of solution, such as 0.3 lbs to 0.7 lbs of solution is applied to 2560 inches of shingle length×2 inches of width, which equals 0.014 lbs/sq ft of the applied area. In one exemplary embodiment, the amount of the second hydrophobic material 710 applied is 0.0028 lbs/sq ft to 0.07 lbs/sq ft.

In certain embodiments, the second hydrophobic material may be applied on a dry basis to the shingle in an amount of greater than 0.0002 g/in$^2$, in other embodiments greater than 0.0003 g/in$^2$, and in other embodiments greater than 0.0004 g/in$^2$. In these or other embodiments, the second hydrophobic material may be applied on a dry basis to the shingle in an amount of less than 0.0015 g/in$^2$, in other embodiments less than 0.001 g/in$^2$, in other embodiments, and in other embodiments less than 0.0008 g/in$^2$. In certain embodiments, the second hydrophobic material may be applied on a dry basis in an amount in the range of 0.0002 g/in$^2$ to from 0.0015 g/in$^2$, in other embodiments from 0.0003 g/in$^2$ to 0.001 g/in$^2$, in other embodiments, and in other embodiments from 0.0003 g/in$^2$ to 0.0008 g/in$^2$.

In certain embodiments, the surfactant may be applied on a dry basis to the shingle in an amount of greater than 0.0001 g/in$^2$, in other embodiments greater than 0.0002 g/in$^2$, and in other embodiments greater than 0.0003 g/in$^2$. In these or other embodiments, the second hydrophobic material may be applied on a dry basis to the shingle in an amount of less than 0.001 g/in$^2$, in other embodiments less than 0.0008 g/in$^2$, in other embodiments, and in other embodiments less than 0.0006 g/in$^2$. In certain embodiments, the second hydrophobic material may be applied on a dry basis in an amount in the range of 0.0001 g/in$^2$ to from 0.001 g/in$^2$, in other embodiments from 0.0002 g/in$^2$ to 0.0008 g/in$^2$, in other embodiments, and in other embodiments from 0.0003 g/in$^2$ to 0.0006 g/in$^2$.

In some exemplary embodiments, the second hydrophobic material 710 is applied neat (as is), in a mixture, in a solvent, or in an emulsion. In certain embodiments, where the second hydrophobic material is applied as in composition that includes a solvent or an emulsion, the composition may be applied to the shingle and then dried. For example, the second hydrophobic material 710 may be applied as an aqueous emulsion to the asphalt adhesive.

In certain embodiments, the second hydrophobic material 710 may be applied in an aqueous emulsion composition that includes a silicone emulsion and a surfactant such as a salt of a fatty acid. The aqueous emulsion composition may be applied on the upper side of the shingle, lower side of the shingle, and/or the adhesive. In certain embodiments, the emulsion composition that includes a silicone emulsion and a salt of a fatty acid is only applied to the adhesive. Advantageously, the silicone emulsion provides hydrophobicity, while the fatty acid salt provides wetting and lubricity that prevents the adhesive from sticking until the shingle is installed on a roof. While the fatty acid is hydrophilic, when combined with the silicone emulsion, the net result is a hydrophobic coating.

In certain embodiments, the aqueous emulsion composition may include from 0.4 wt % to 2 wt %, in other embodiments from 0.5 wt % to 1.5 wt %, and in other embodiments from 0.6 wt % to 2 wt % of the silicone emulsion. In these or other embodiments, the composition may include from 0.1 wt % to 1.5 wt %, in other embodiments from 0.2 wt % to 1 wt %, and in other embodiments from 0.3 wt % to 0.5 wt % of the salt of fatty acid.

In certain embodiments, a silane solution having a silane concentration in the range of about 0.25 wt % to 2 wt % was applied to the back of a shingle sheet during production at a rate of about 0.3 g silane/sq to 6 g silane/sq (one sq is 300 sf of shingles). The silane solution increased the contact angle of the sheet at 10 minutes from the 40 degree to 60 degrees range to the to the range of 80 degrees to 120 degrees. In one exemplary embodiment, a silane solution having a silane concentration of about 0.5% was applied to the back of a shingle sheet during production at a rate of about 1.1 g silane/sq. The silane solution increased the dynamic contact angle of the sheet at 10 minutes from to range of 40 degrees to 60 degrees range to the range of 80 degrees to 120 degrees As such, after the silane solution was applied to the back of the sheet and the sheet was cut into shingles and bundled, the bundles of shingles did not wick water in between the layers of shingles.

In certain embodiments, the back of shingle sheets were sprayed with a silane solution having a silane concentration of 0.5% during production at the rate of 0.7 g silane/sq. The sheets were cut and laminated into shingles and wrapped into bundles with 2.2 mil polyethylene wrappers. Bundles of shingles (both treated and untreated) were then placed on pallets in a shower that delivered 44 inches of water to the bundles over a 48 hour period. The wrappers were opened and the shingles were observed for water. The bundles having been treated shingles were almost completely dry (i.e., less than 25% of the bottom surface area of the second shingle from the top of the stack was wet) while the bundles of untreated shingles contained substantial amounts of water between the shingles (i.e., greater than 25% of the bottom surface area of the second shingle from the top of the stack was wet).

Figure 8A:
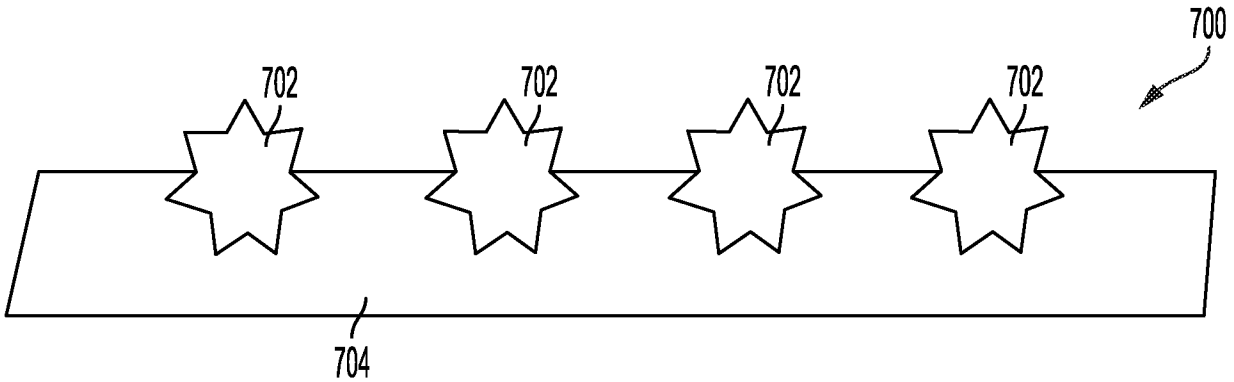
FIG. 8A illustrates an exemplary embodiment of particles embedded in an asphalt coating of a shingle.
Figure 8B:
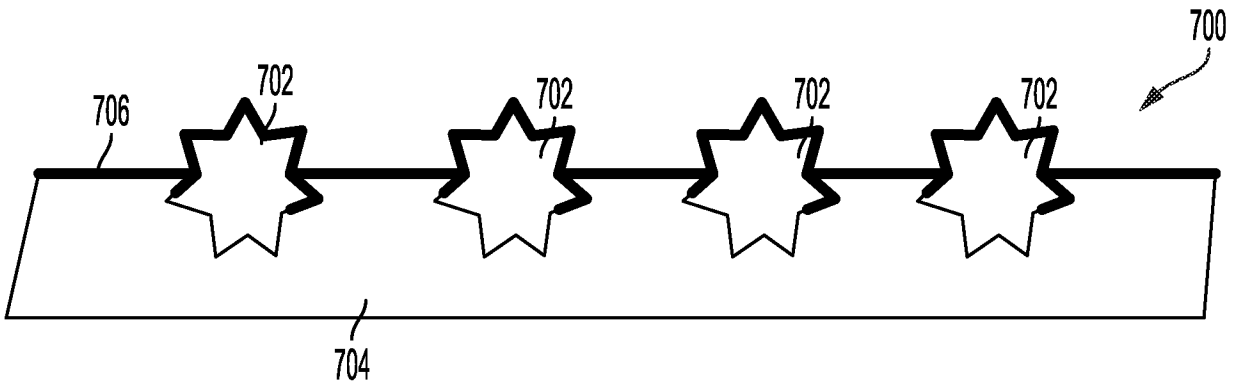
FIG. 8B illustrates an exemplary embodiment of a hydrophobic material applied to the particles and asphalt coating of the shingle of FIG. 8A.

The silane bonds to the lower surface of the shingle, including the surfaces of the backdust particles, and will generally only be a few monolayers thick at the concentrations used (e.g., between 0.25% to 2% silane). As such, the silane produces a hydrophobic surface but does not prevent laminating adhesives and adhesives from bonding to the back of the shingle. For example, FIG. 8A illustrates backdust particles 702 embedded in the asphalt coating 704 of a shingle 700. FIG. 8B illustrates silane 706 applied to the lower surface of the shingle 700 while the asphalt coating is still hot. As shown, the silane 706 coats the backdust particles, the lower surface between the backdust particles 702, and also seeps in between the backdust particles and the asphalt coating.

As shown in FIG. 2A, shingles are often formed from shingle sheets laminated together with an adhesive. Further, a shingle adhesive is generally applied to the surface of a shingle and is used to bond adjacent shingles together when installed on a roof. Adhesives may be applied to the surface of a shingle before and/or after the hydrophobic coating is applied to the surface of the shingle. Applicants have discovered that adding the silane solution to the surface of the shingle does not affect the bond strength between two shingles via the adhesive, but actually may enhance the bonding of the shingles together with the adhesive. For example, Applicants tested sheets having 0.25% and 0.5% silane solutions sprayed on the back of the shingle sheet while the asphalt was still hot at a rate of 0.16 lb of solution/100 sq. ft. No reduction in bond strength between the shingles per ASTM D3462, which is incorporated herein by reference, due to the addition of the silane was observed in any of the tests. In some of the tests, the bond strength between the shingles increased with the silane solution. Thus, adding the silane solution to one or more surfaces of a shingle does not affect the bond strength between two shingles via the adhesive but instead can enhance the bonding between the shingles.

As discussed herein, the addition of a hydrophobic material (e.g., the hydrophobic coatings and hydrophobic particles discussed herein) prohibits moisture from infiltrating between the stacked shingles. As such, the hydrophobic material reduces granule loss during handling and installation of the shingles and reduces the ability of the shingles to freeze together in cold weather. Furthermore, the hydrophobic material may increase shingle life by keeping the underside of the shingle dry on the roof and preventing water infiltration under the shingle. The hydrophobic material may also help reduce leaks by preventing water from wicking under shingles. Also, the hydrophobic material may reduce the wet time of shingles on the roof, which has been shown to directly correlate to reduced algae growth, thus reducing the need for algae resistant granules.

As described herein, when one or more components are described as being connected, joined, affixed, coupled, attached, interfaced, or otherwise interconnected, such interconnection may be direct as between the components or may be indirect such as through the use of one or more intermediary components. Also, as described herein, reference to a "member," "connector", "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions, such as alternative materials, structures, configurations, methods, devices and components, alternatives as to form, fit and function, and so om, may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. A shingle comprising:

a substrate having a first surface defining an upper side of the shingle and an opposing second surface defining a lower side of the shingle;

asphalt infiltrating the substrate to form a first asphalt coating on the first surface of the substrate and a second asphalt coating on the second surface of the substrate;

a plurality of granules embedded in the first asphalt coating;

a first hydrophobic material; and a second hydrophobic material that is a different composition than the first hydrophobic material, the second hydrophobic material comprising a metal stearate, wherein the upper side of the shingle includes an upper surface, and wherein the first and the second hydrophobic material are disposed on the upper surface.

2. The shingle of claim 1, wherein the shingle further includes a layer of backdust disposed on the second asphalt coating.

3. The shingle of claim 1, wherein the second hydrophobic material is disposed on the first hydrophobic material.

4. The shingle of claim 1, wherein the shingle is a laminated shingle.

5. The shingle of claim 1, wherein the first hydrophobic material comprises silanes, waxes, silicones, siloxanes, styrene-butadiene rubber (SBR), esters of acrylic resins, or combinations thereof.

6. The shingle of claim 1, wherein the first hydrophobic material includes a silicone selected from the group consisting of polyether-modified siloxane, polyether-modified polysiloxane, polyether-modified polydimethylsiloxane, dimethyl silicone fluid, emulsions of silicone rubber, silicone oil, and polydimethylsiloxane.

7. The shingle of claim 1, wherein upon application, the first hydrophobic material comprises a solution or aqueous emulsion.

8. The shingle of claim 1, wherein the metal stearate is zinc stearate, calcium stearate, magnesium stearate, or combinations thereof.

9. The shingle of claim 1, wherein the shingle further includes an adhesive disposed on the lower surface.

10. A shingle comprising:

a substrate having a first surface defining an upper side of the shingle and an opposed a second surface defining a lower side of the shingle;

an asphalt composition infiltrating the substrate to form a first asphalt coating on the first surface of the substrate and a second asphalt coating on the second surface of the substrate;

a plurality of granules embedded in the first asphalt coating;

a hydrophobic material and a surfactant, wherein each of the hydrophobic material and the surfactant are disposed on the upper side of the shingle.

11. The shingle of claim 10, wherein the surfactant comprises a salt of a fatty acid.

12. The shingle of claim 11, wherein the salt of a fatty acid is selected from sodium laurate, potassium oleate, sodium oleate, sodium stearate, or combinations thereof.

13. The shingle of claim 10, wherein the hydrophobic material and surfactant are disposed on the upper side of the shingle as a mixture.

14. The shingle of claim 10, wherein the hydrophobic material is disposed the upper side of the shingle and the surfactant is disposed on at least a portion of the hydrophobic material.

15. The shingle of claim 10, wherein the surfactant is disposed on at least a portion of the upper side of the shingle and the hydrophobic material is disposed on at least a portion of the surfactant.

16. The shingle of claim 10, wherein the shingle further includes a layer of backdust on the second asphalt coating.

17. The shingle of claim 10, wherein the shingle is a laminated shingle.

18. The shingle of claim 10, wherein upon application, the first hydrophobic material comprises a solution or aqueous emulsion.

19. The shingle of claim 10, wherein the shingle further includes an adhesive.

* * * * *